United States Patent [19]

Irwin

[11] 4,275,968

[45] Jun. 30, 1981

[54] SYSTEM FOR CONTROLLING AND SEQUENCING A PRINTER

[75] Inventor: John W. Irwin, Loveland, Colo.

[73] Assignee: IBM Corporation, Armonk, N.Y.

[21] Appl. No.: 34,841

[22] Filed: Apr. 30, 1979

[51] Int. Cl.[3] ..... B41J 13/00

[52] U.S. Cl. ..... 400/582; 101/232; 271/3; 271/270; 355/14 SH; 358/296; 364/105; 364/118; 400/126

[58] Field of Search ..... 101/232, 382 MU; 271/3, 271/4, 196, 270, 276; 318/329, 326, 327, 490; 346/75, 134; 355/14 SH, 14 C; 358/296; 364/900 MS File, 105, 518, 514, 519, 118; 400/126, 320, 322, 323, 74, 582, 583.4, 625, 627–629

[56] References Cited

U.S. PATENT DOCUMENTS

| | | | |
|---|---|---|---|
| 3,741,640 | 6/1973 | Hickey et al. | 355/3 |
| 3,768,904 | 10/1973 | Rodek | 355/40 |
| 3,774,056 | 11/1973 | Sample et al. | 307/293 |
| 3,784,190 | 1/1974 | Crawford | 271/309 |
| 3,843,114 | 10/1974 | Kojima et al. | 271/3 |
| 3,887,796 | 6/1975 | Trousdale et al. | 235/151 |
| 3,922,587 | 11/1975 | Jones | 317/123 |
| 3,935,434 | 1/1976 | Rice et al. | 235/92 CT |
| 3,940,210 | 2/1976 | Donohue | 355/14 |
| 3,944,360 | 3/1976 | Deetz et al. | 355/14 |
| 4,050,564 | 9/1977 | Carmichael et al. | 400/320 X |
| 4,130,785 | 12/1978 | Penet | 318/327 X |
| 4,147,967 | 4/1979 | Aiena | 400/322 X |

FOREIGN PATENT DOCUMENTS

| | | | |
|---|---|---|---|
| 2803698 | 8/1978 | Fed. Rep. of Germany | 400/126 |

OTHER PUBLICATIONS

IBM Tech. Disc. Bulletin, "Adaptive Printer Carriage Rate Limiter", by H. R. Bublitz et al., vol. 19, No. 8, Jan. 1977, pp. 2981–2983.

IBM Tech. Disc. Bulletin, "Updating Records in Place", by N. K. Arter et al., vol. 17, No. 4, Sep. 1974, pp. 972–973.

*Primary Examiner*—Paul T. Sewell

*Attorney, Agent, or Firm*—Allan Ratner; Carl M. Wright

[57] ABSTRACT

Printer having a sheet feed and drum transport assembly and an array transport assembly, these assemblies having critical operating parameters whose profile is measured during a nonprinting cycle executed for that purpose. These critical operating parameter values are sorted and used as the values of the respective critical parameters during the printing cycles after the profiling cycle. The values may be updated according to detected variances occurring during the printing cycles. In addition, the value of the paper position is determined during an initial printing cycle and stored and used in subsequent cycles.

32 Claims, 8 Drawing Figures

SYSTEM FOR CONTROLLING AND SEQUENCING A PRINTER

BACKGROUND OF THE INVENTION

A. Field of the Invention

This invention relates to the control and sequencing of printers and particularly to controlling and sequencing the sheet feed and drum transport and the array transport.

B. Prior Art

Printers, such as those used in copiers, have in the past controlled and sequenced in various ways the mechanisms for feeding the sheet, transporting the drum, and transporting the array which applies the ink. In view of the mechanical nature of these mechanisms, certain operating parameters are critical during a printing cycle, e.g., acceleration and deceleration. These mechanisms function satisfactorily while these critical parameters are within certain tolerances. There have been two basic choices in setting up such tolerances for printer operation. First, if the printer is set to function within a narrow tolerance band, the printer then has good operating performance while the critical parameters remain within that band. This usually requires frequent and costly service calls by service personnel to maintain satisfactory operation by adjusting those narrow tolerances. Secondly, printers set up with a wide tolerance band at the factory result in machines having large performance variations among machines. For example, where a critical parameter involves the speed of the machine, with a wide band of tolerances a fast machine will sometimes give poorer overall performance than a slower machine though both machines are within the tolerance band. Thus, in a particular example of an ink jet printer in a copier system, a fast acting servo actually causes the system to perform more poorly than a slower acting servo because a fast servo brings the print drum down to load speed quickly. The print drum, however, must remain at the lower load speed until a paper load point on the drum has been reached since the printer can accept paper only at certain load points. Thus, there has been no gain, but rather a loss, in efficiency when the drum reaches a slow load speed at an early time. For maximum system efficiency, the fast servo should have remained longer at the faster print speed in order that a load point on the drum be brought up sooner.

Accordingly, an object of the present invention is to adapt the operation of a printer to its critical parameters that actually exist and are being used rather than within some arbitrary tolerance band.

Another object is substantially to eliminate critical adjustment of the printer mechanism by determining the existing running values of the critical parameters and using these existing running values as a profile for use during the printing cycle.

SUMMARY OF THE INVENTION

A system for printing having a plurality of operating parameters. At least a predetermined one of the operating parameters is critical in a cycle of printing a copy. During a special cycle for profiling the critical operating parameter, means is provided for determining the actual value of the critical parameter. The critical operating parameter value is stored and means is provided for using the stored value as the value of that critical operating parameter during printing cycles subsequent to the profiling cycle.

DESCRIPTION OF THE PREFERRED EMBODIMENT

Figure 1:
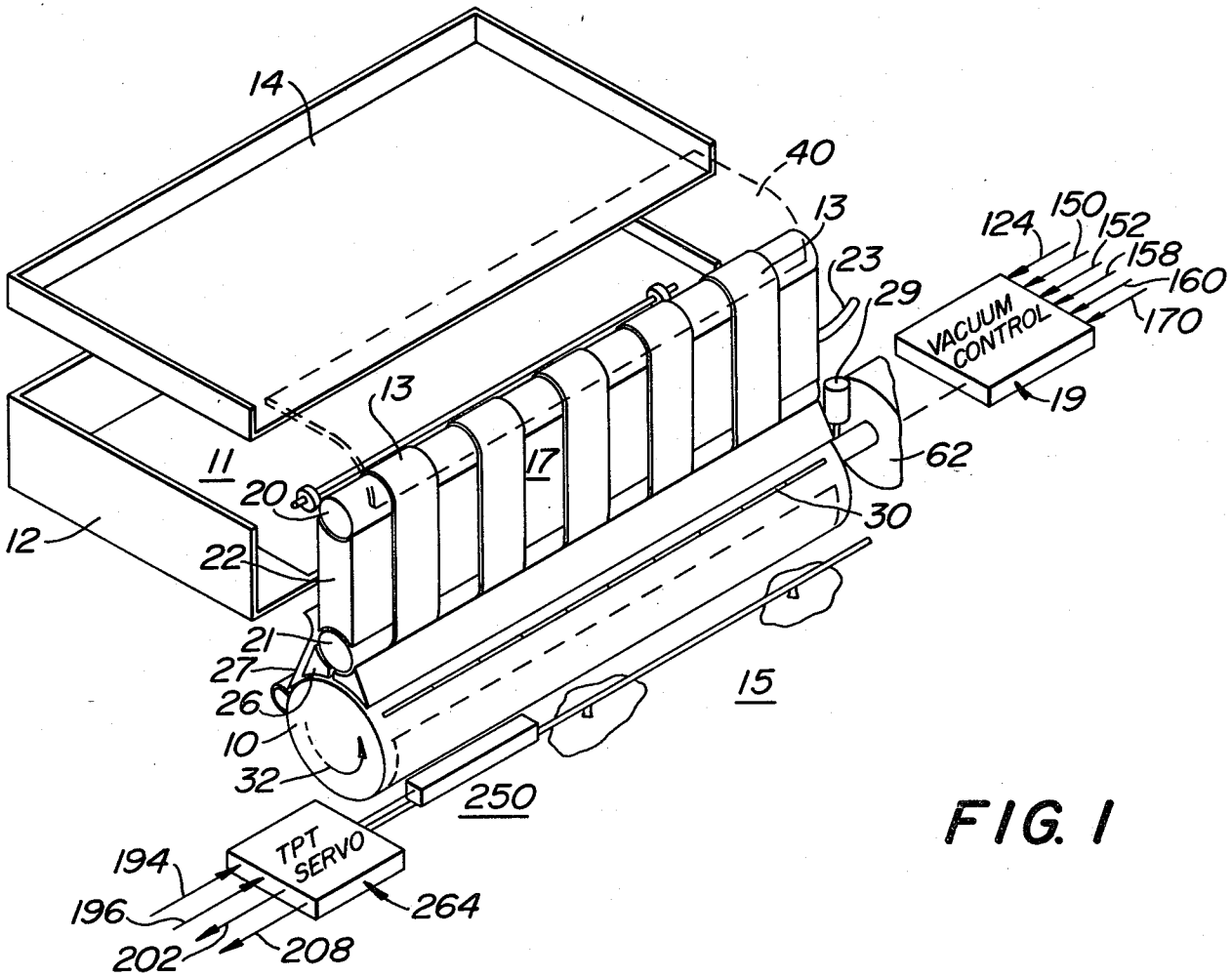
FIG. 1 is a perspective view of a copier system having a printer with a controlled and sequenced sheet feed, drum and array transport of the present invention.

In FIG. 1, a copier system 15 is shown having a printer with a sheet feed and drum transport assembly 17. The printer may be of the ink jet type having ink jet nozzles (not shown) carried by an array transport system 250. Copier system 15 provides control and sequencing for sheet feed and drum transport assembly 17 and for array transport system 250. The ink jet nozzles may be driven by input data from a document scanning system which includes a scanner and a source organizer to feed a data memory with the image data being stored and then applied to the ink jet arrays. Such a document scanning system is described in U.S. Pat. No. 4,069,486, issued Jan. 17, 1978, to S. J. Fox, titled Single Array Ink Jet Printer and assigned to the assignee herein. This patent is incorporated herewith by reference.

Figure 5:
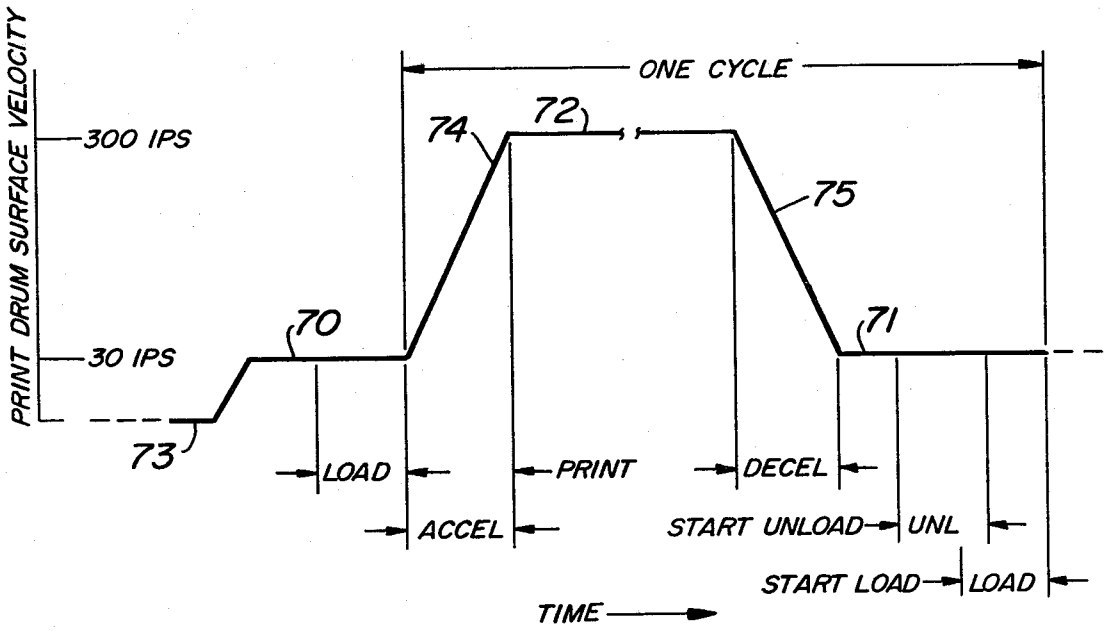
FIG. 5 is a velocity profile of the drum of FIG. 1.

Assembly 17 of copier system 15 has a rotary drum 10 which is fed single flexible sheets 11 from bin 12 by conveying belt 13. After being processed, the sheets are fed by the same belts 13 from drum 10 to an output bin 14. Conveyor belts 13 are mounted on driving roll 20 and on idle roll 21. A vacuum plenum 22 is provided interior to belts 13 with the plenum being connected by way of a conduit 23 to a vacuum source. A solenoid 29 operates a mechanical paper gate of assembly 17 into the sheet path between guides 26 and 27 to prevent any sheet from proceeding to drum 10 until that sheet is released. Drum 10 is driven in a load mode and in a print mode by a drum motor and servo assembly 62. These modes are shown in FIG. 5 in which the load modes are indicated by segments 70, 71 and the print mode by segment 72. For the purpose of definition herein, segment 71 will be called a load mode even though it actually comprises both an unload and a load mode.

In conventional manner, vacuum control 19 is coupled to drum 10 with conduits to provide both vacuum and pressurized air. Specifically, control 19 is effective to provide leading edge and trailing edge vacuum as well as pressurized air. Vacuum control 19, servo assembly 62 and other details of the sheet feed and drum transport are described in detail in application Ser. No. 919,898 filed June 28, 1978, by E. C. Korte titled Sheet Feed and Transport and assigned to the assignee herein. This application is incorporated by reference herein.

Figure 2A:
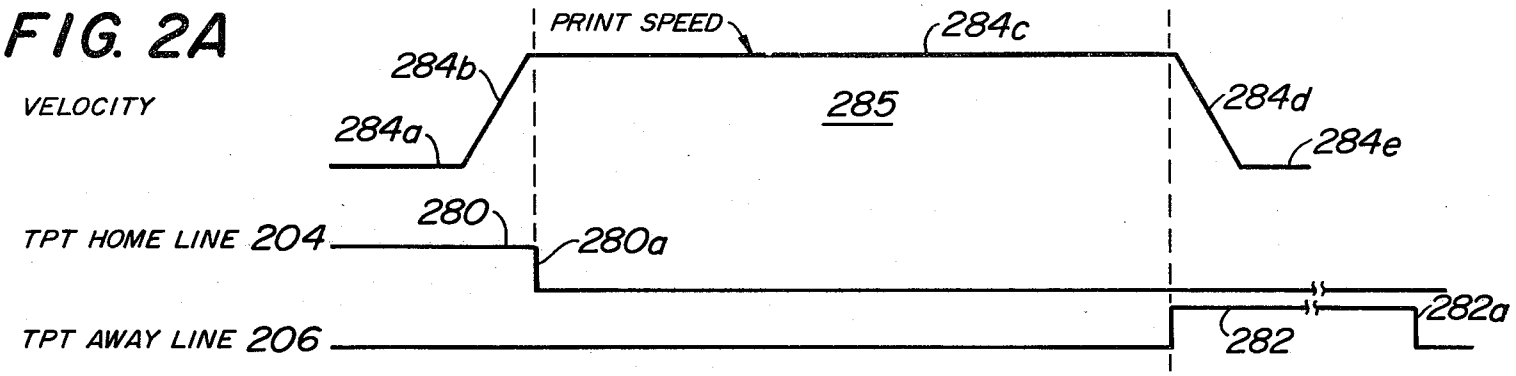
FIG. 2A is a velocity waveform useful in explaining the operation of 2B.
Figure 2B:
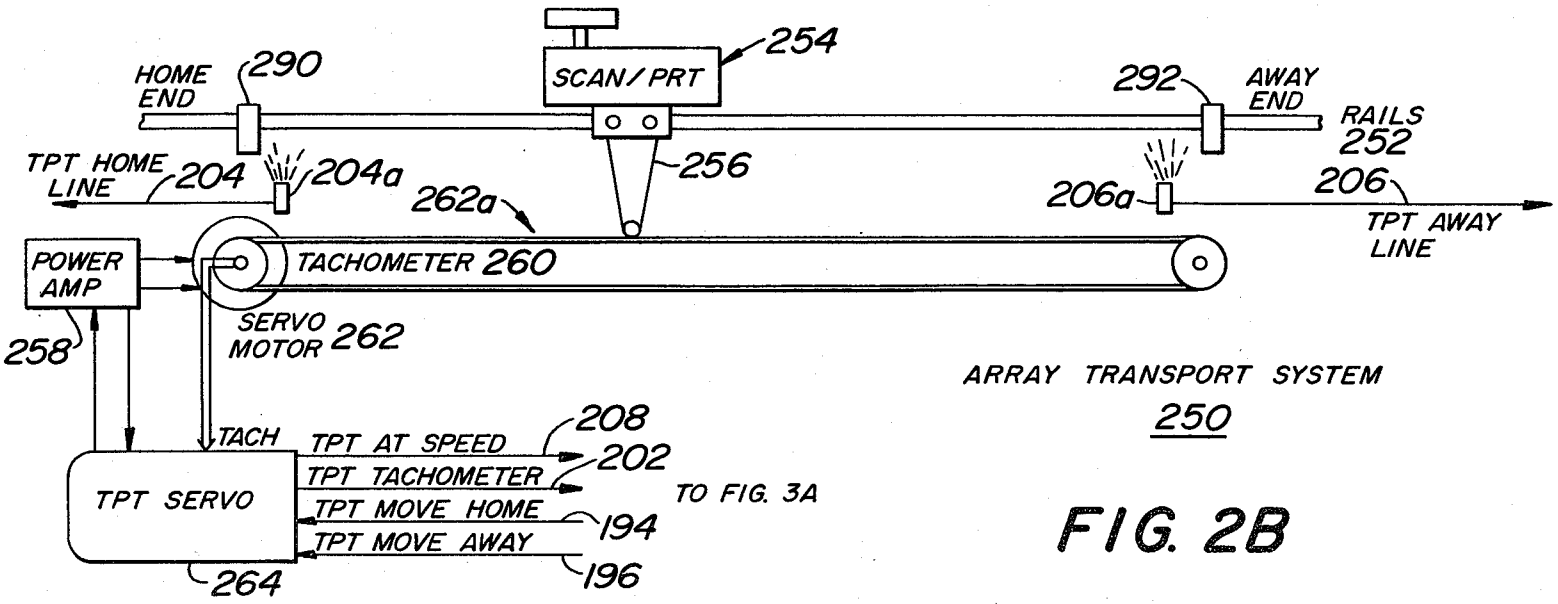
FIG. 2B is a diagrammatic illustration of an array transport system of FIG. 1.
Figure 3A:
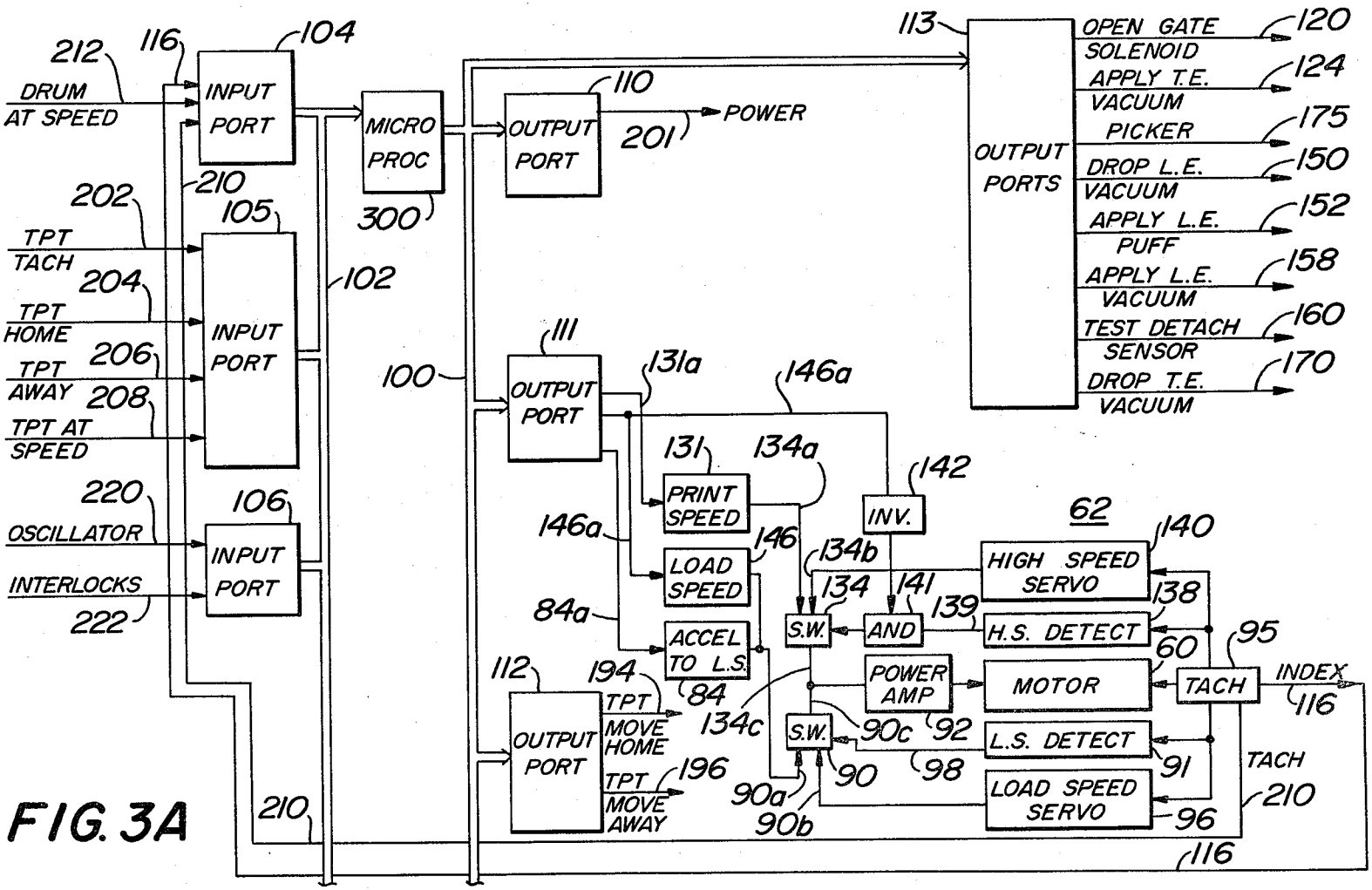
FIGS. 3A–3B taken together form a block diagram of the control and sequencing system for the sheet feed, drum and array transport of FIGS. 1 and 2B.
Figure 3B:
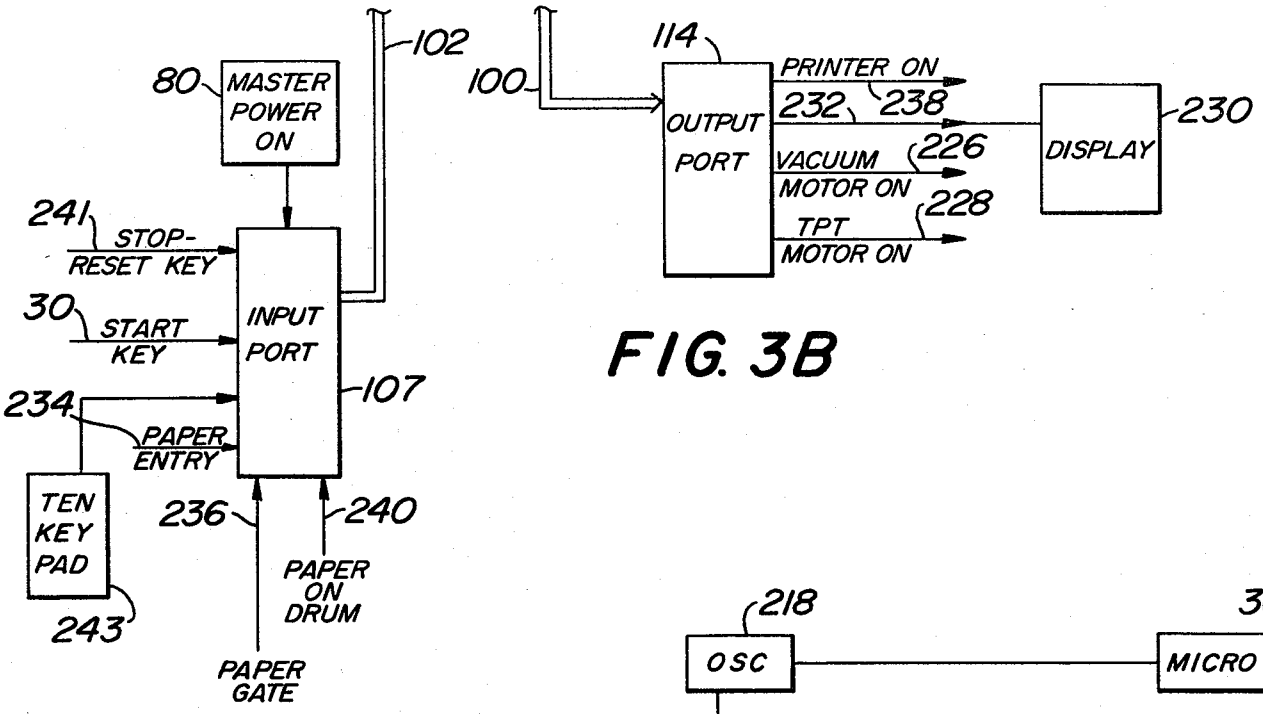

FIGS. 3A–3B show most of the details of the control and sequencing system for the sheet feed and drum transport assembly 17 and array transport system 250. A portion of this system as applied to array transport system 250 is also shown in FIG. 2B. In FIGS. 3A–3B, the system includes microprocessor 300 which may be programmed by firmware and has input ports 104–107 and output ports 110–114. Output port 111 supplies signals to the drum motor and servo assembly 62 and the assembly supplies signals to input port 104. Output port 112 provides signals to the TPT servo assembly 264 (FIGS. 1, 2B) which in turn provides input signals to input port 105. Selected inputs and outputs of input port 107 and output port 114 are coupled to an operator's panel which includes display 230, ten key pad 243, start key 30, and stop-reset key 241. The remaining input and output ports are coupled to sheet feed and drum transport assembly 17 and vacuum control 19 as shown in FIG. 1.

Output port 111 is coupled by way of a line 84*a* to a low speed acceleration circuit 84. Circuit 84 produces an acceleration waveform to drive motor 60 of assembly 62 from a stop to a load speed. The output from circuit 84 is applied to a switch 90 which is operated by a load speed detector circuit 91 to a one state. In this one state, the output of circuit 84 is applied by way of switch input 90*a* and output 90*c* and through a power amplifier 92 to motor 60. Amplifier 92 is effective to convert the voltage input signal to a drive current. As a result, motor 60 accelerates drum 10 from a stop to a load speed 70, as shown in the waveform of FIG. 5, in accordance with the signal from circuit 84.

Motor 60 is coupled to a tachometer 95 which provides a tach signal to both a load speed detector circuit 91 and a load speed servo circuit 96. Circuit 91 is thus switched into operation when the pulse rate from tachometer 95 is within a specified percentage of the desired load speed. When the pulse rate enters the desired frequency band, circuit 91 is effective to switch circuit 90 from a one state to a two state. When in the two state, switch 90 connects switch input 90*b* to output 90*c*. In the absence of a signal on line 98, switch 90 switches back to its one state. Accordingly, when actuated to the two state, switch 90 applies the output of load speed servo 96 to power amplifier 92. When drum 10 has reached load speed, the drum at speed line 212 supplies a signal to port 104 of microprocessor 300.

Tachometer 95 is also connected by way of an index output line 116 to input port 104. The input signal on line 116 occurs once per drum revolution and indicates a specific rotational position of drum 10. More frequent pulses are produced by tachometer 95 on tach line 210 which is also applied to input port 104.

Furthermore, a high speed detector 138 is similar to low speed detector 91 except that it operates at a substantially higher frequency. With motor 60 not at high speed, no signal is applied on line 139 and switch 134 is in the one state. Since switch 134 operates similarly to switch 90, switch 134 connects the output of an accelerate to print speed circuit 131 through switch input 143*a* and output 134*c* to power amplifier 92. Accordingly, the amplifier responds to the waveform from circuit 131 thereby to drive motor 60 to accelerate from load speed to print speed as shown by segment 74, FIG. 5. Upon reaching print speed, circuit 138 provides a signal on line 139 through AND gate 141 to actuate switch 134. As a result, switch 134 then connects high speed servo 140 to amplifier 92. Accordingly, as shown in FIG. 5, system 15 is brought to print speed 72 and may begin printing a copy.

In deceleration as shown by segment 75, FIG. 5, load speed circuit 146 is effective through switch 90 to provide a deceleration waveform to amplifier 92. A signal on line 146*a* is effective by way of inverter 142 to block AND gate 141 so that no signal is applied from detector circuit 138 to switch 134. In this manner, motor 60 and drum 10 are decelerated to the load speed. Load speed detector 91 and load speed servo 96 then function in the manner previously described to take over the drive of motor 60. The specific inputs and outputs of input ports 104–107 and output ports 110–114 will later be described with respect to the operation of system 15.

FIG. 2B shows array transport system 250 and a velocity waveform 285 of transport 254 formed of a scanner and printer coupled together. Transport 254 is secured to a wheeled carriage 256 which rides on rails 252. Carriage 256 is driven by a servo motor 262 by way of a steel tape 262*a*. Servo motor 262 has a shaft which is coupled to a tachometer 260. Servo motor 262 is energized by a power amplifier 258 which is in turn controlled by a TPT (transport) servo 264 which is also coupled to tachometer 260. As previously described, TPT servo 264 has two outputs, TPT at speed line 208 and TPT tachometer line 202, both coupled to input port 105. The inputs to TPT servo 264, TPT move home line 194 and TPT move away line 196, are coupled to putput port 112.

At both ends of rails 252, there are provided a pair of photosensors, viz., home end sensor 204*a* and away end sensor 206*a*, which are actuated by a flag which is riding on transport carriage 256. There is further provided a home end stop 290 which is at the extreme home end of rails 252 and away end stop 292 which is at the extreme away end of the rails. Thus, home end sensor 204*a* defines the distance between stop 290 and its closest respective edge of the paper while sensor 206*a* defines the distance between stop 292 and its closest respective edge of the paper 11. It will be understood that when transport 254 leaves the home end or the away end, its acceleration should always be complete before reaching the closest respective edge of paper 11 so that printing is accomplished at a steady rate.

The operation of copier system 15 will now be described with respect to the control and sequencing for the sheet feed and drum transport assembly 17 and array transport system 250. The listing for the program for microprocessor 300 appears at the end of the specification as an appendix and is written in a structured format understandable by those of ordinary skill in the art. The operation starts with an initialize sequence. For executing the code, microprocessor 300 may may be an I/O processor used with the IBM Series I computer.

Initialize

As set forth in paragraph 4 of the listing, to start system 15, a master power on switch 80 (FIG. 3B), is actuated and INIT is accessed. The first operation is a reset signal on line 224 applied to POWER ON RESET (POR latch 324, FIG. 4). At this time, a COPY REQUEST flag is also reset. In the next step, turning on the MAIN POWER RELAY brings up line 201 in FIG. 3A. The code drops through another entry, INIT1, paragraph 4.2, which is entered after handling an error, such as a jam. This is the location the code would enter after a jam has been cleared. All the ERROR FLAGs are reset and the NOT READY LIGHT is turned on; remaining on until system 15 is brought up to usable condition which takes some time. Next, the function utility routine reset panel (RSTPNL—paragraph 5.1) is called. This routine brings the operator's panel, paragraph 3, back to power on condition. The COPY REQUEST COUNT is set to one and applied to display 230.

Thereafter, the PROFILE COMPLETE FLAG is reset. This flag is a software flag that is turned on after a successful profile of the system is made. This is effective to force the profile routine in paragraph 15 to be run during the initializing phase. Also reset is LOAD ADJUST FLAG, another software flag which will be set when paper 11 has successfully been loaded on drum 10. Meanwhile, a nominal load time of 152 is set into variable CALCLOAD. If the HEAD UP FLAG is off, then a subroutine called INKUP is run. INKUP, described in paragraph 5.5, brings up all of the pressures in the ink lines and checks all of the levels in the ink system. If this is successful, the HEAD UP FLAG is set with return to the main program flow.

The initialize routine in paragraph 4 then turns off the NOT READY LIGHT and the system proceeds to the IDLE routine in paragraph 6 unless the COPY REQUEST flag is on. If this were an error handling case, the RETRY routine in paragraph 4.3 would be executed. If RETRY has been executed, an error light would be displayed in display 230. The operator may then clear the jam and he has two options. In the first option, he may actuate a RESET KEY which cancels the remaining copy run and there is a return to IDLE, paragraph 6.0. As a second option, the operator may actuate the start key or switch 80 after clearing the jam and then the code at STARTIT, paragraph 7, is executed. The run is continued and the required additional number of copies are made so that the total number is correct.

The IDLE routine, paragraph 6, waits for the operator to request copies from system 15. This is the normal idle state of system 15. As the first step, the COPIES COMPLETE flag is set to zero and the NO USE TIMER is reset to zero. A DOUNTIL loop is then entered and continued until there is a closure of start key 30 or a closure of reset key 241 or any ERROR FLAG comes on or COVER INTERLOCK OPEN is set. Ten key pad 243 is then integrated which means that the system takes several successive samples for noise rejection. If the samples are the same, then the switch on pad 243 is actually closed. Thereafter, display 230 is updated with anything that has been keyed in. There is an integration of switches and if there is any paper in the path anywhere (there should be no paper in system 15 other than in the input bins during IDLE) ERROR FLAG 1 is set. Furthermore, other switches are also integrated and the normal way out of this routine is STARTIT, paragraph 7.

It will be understood that copier system 15 may be a convenience copier and, over a lunch period or a long meeting, may remain idle for a substantially long period of time. During that time, the critical parameters may possibly change. Accordingly, as set forth in paragraph 6, if the NO USE TIMER overflows, then there is a reset of the PROFILE COMPLETE FLAG and the LOAD ADJUST FLAG. Accordingly, a new profile is performed and the nominal paper loading time is also reinitialized.

In the STARTIT routine, paragraph 7, a COPY REQUEST flag is set and remains on until the run is completed successfully. The DONE FLAG is cleared until the last copy is run. As the next step, energizing signals are applied by way of vacuum motor line 226 and transport motor line 228 from output port 114. If the PROFILE COMPLETE FLAG is off (it will always be off for the first copy of the day), the PROFILE routine, paragraph 15, is called in order to characterize system 15 and to determine the existing running values of the critical parameters during a nonprinting cycle. These actual running values provide a profile and they are stored and used during the subsequent printing cycles.

Drum Profiling

The PROFILE routine, paragraph 15, calls a subroutine STP2LOAD, paragraph 5.9, to bring drum 10 up to load velocity with a minimum of checking since this is not a critical part of the cycling. As shown by the waveform in FIG. 5, velocity at rest is indicated by segment 73 and STP2LOAD routine accelerates drum 10 from this zero velocity segment 73 up to load velocity segment 70. It will be understood that the status here is noncritical as the routine indicates that TIMER is to be set to 45 milliseconds. This time is set in processor 300 with respect to an oscillator 218, FIG. 6. TIMER is loaded with a constant representing 45 milliseconds and there is a countdown once every 125 microseconds which produces a delay of 45 milliseconds. In the next step of the listing, the ACCEL TO LOAD SPEED command in block 84 and the LOAD SPEED command in block 146 to the drum 10 are set which brings the drum up from segment 73 to segment 70 in FIG. 5. A DOUNTIL loop is then performed until the TIMER counts down by MSTIMER (paragraph 5.2) to zero or until drum 10 applies to input port 104 a DRUM AT SPEED signal by way of line 212, FIG. 3A.

Figure 6:
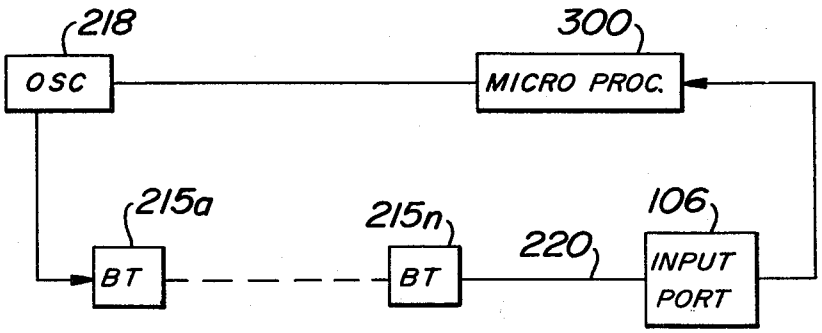
FIG. 6 is a block diagram of a loop including an oscillator and microprocessor of FIGS. 1, 3A-3B and 4.

As shown in FIG. 6, oscillator 218 is in a loop with a series of binary triggers 215*a*–215*n*. The output of the last binary trigger 215*n* provides on line 220 a pulse wave shape of 125 microseconds per phase. This wave shape is applied through input port 106, FIG. 3A, back to microprocessor 300. In this manner, there is achieved a saving in overhead in microprocessor 300.

In the MSTIMER routine, paragraph 5.2, oscillator 218 is sampled. Specifically, every time oscillator line 220 changes, there is an update in TIMER function which in a count in one of the registers in microprocessor 300. If oscillator line 220 has changed, TIMER is updated and if it has not changed, the program returns to the main program flow. The MSTIMER routine tracks line 22 as long as these calls are not too far apart.

After each call of MSTIMER, the program responds to the value of TIMER and at the DRUM AT SPEED line 212. Two events can bring the program out of this DOUNTIL loop. The first event is that TIMER reaches zero before drum 10 accelerates to load speed 70 which indicates that there is a defective drum. In that event, ERROR FLAG 2 is set and an error handling routine is called. In the second event, the DRUM AT SPEED line 212, FIG. 3A, provides a signal before TIMER equals zero which indicates that the drum accelerated in a satisfactory manner. In the second event, the program returns to the caller and the PROFILE routine is returned to. Assuming the second event, in the next step of the PROFILE routine, another routine called check load velocity (CKLDVEL), paragraph 5.11, is called. This routine insures that after the drum accelerates from stop segment 73 to load speed 70, FIG. 5, drum 10 is actually stabilized at segment 70 at an acceptable velocity so that paper may be loaded. A microprogrammed loop is now used to count microprogrammed cycles within the loop using microprocessor 300 as a clock for this function. The program responds to transitions of tachometer line 210 to time eight of such transitions and ascertains that these eight transitions take place within an acceptable time window tolerance as determined by service requirements. A variable called COUNT is now set to zero and placed in a register in microprocessor 300. Another function, viz., LOOP, is set to zero and is also placed in a register in microprocessor 300.

The present state of TACHOMETER from tachometer 95 is placed in register NOW. A DOUNTIL loop is started and the loop is continued until tachometer 95 produces an output not equal to NOW. In other words, a change in the value of TACHOMETER is being checked for. Then a routine, GETPULS, paragraph 5.3, later described in detail, is called. This routine essentially keeps track of tachometer 95. It is desired to be on the edge of a TACHOMETER change so that the timing may be started which continues until the TACHOMETER count equals eight. In this manner, as TACHOMETER is sampled, the routine also increments LOOP for each sample. The LOOP variable is the accumulated number of times that the TACHOMETER sample loop was executed. If the incremented LOOP is more than a predetermined maximum or less than a predetermined minimum, an ERROR FLAG 2 is set which designates a drum error and an error handling routine is called. If LOOP is between these two constants, then the program returns to the main program flow which indicates that load velocity 70 is within the proper limits.

Accordingly, the program returns to PROFILE, paragraph 15, and sets TIMER to 257 milliseconds. This is a little over one revolution of drum 10 at load velocity 70. It is now determined whether a pulse is present on index line 116 which is coupled to input port 104. If the index pulse is not present, there is no reference to the position of drum 10. Accordingly, TIMER is set to a value representing little more than the time of one revolution of drum 10 and another DOUNTIL loop is executed until TIMER is zero or an INDEX FLAG is seen. MSTIMER, paragraph 5.2 is called to count down the TIMER and GETPULS is called, paragraph 5.3, which tracks tachometer 95.

In GETPULS, paragragph 5.3, an INDEX FLAG is first reset and the signal on tachometer line 210 is received as is INDEX PULSE on line 116 from input port 104. If the INDEX PULSE is one, the INDEX FLAG is set and then the TACH COUNT is zeroed to prevent accumulated errors. If the INDEX PULSE is not on, then TACHOMETER readings are compared and if the TACHOMETER reading is the same as the last sample, then the program returns to the caller. If the TACHOMETER reading is different, then TACH COUNT is incremented and there is a return to the main program. It will be understood that on the average, GETPULS must be called at least once during each tach pulse so that none of these pulses are missed.

The PROFILE routine calls GETPULS the first time it is going to correct the OLDTACH flag and may make on erroneous count. However, after that, the first time an index is detected on line 116, there is a locking into the correct count and thereafter the correct count is kept. If the program comes out of the DOUNTIL and TIMER is not zero, then the index is working correctly.

In the next step, LD2PRT, paragraph 5.10, is called. This brings drum 10 up to print velocity 72 from load velocity 70 through a velocity slope 74 shown in FIG. 5. It should be noted that this change from segment 70 to 72 is the acceleration which is a critical parameter of system 15.

In the LD2PRT routine, drum 10 is brought up to print speed and TIMER is set to 700 milliseconds which is the value of maximum allowable time. By way of output port 111, FIG. 3A, blocks 84 and 146 have previously been set to reach load speed. To reach print speed, blocks 84 and 146 are dropped and print speed block 131 is raised. A DOUNTIL is then executed until either TIMER equals zero or DRUM AT SPEED signal 212 comes up using MSTIMER, paragraph 5.2. If TIMER reaches zero, this indicates a drum error. Otherwise, the routine returns to the main program flow.

As previously described in the LD2PRT routine, TIMER had been set at 700 milliseconds as a safety time out. Accordingly, when the program returns to the main program, whatever is left in TIMER is a measure of how long drum 10 actually took to get up that speed. This residual of elapsed time is arithmetically converted in the processor 300 and is stored as ACCTIM (accelerate time) which is an existing running value of a critical parameter determined during this nonprinting profile cycle.

To check whether the index pulse on index line 116 is present at high speed, TIMER is set at 33 milliseconds which is one millisecond more than a full revolution of drum 10 at print velocity 72. The routines MSTIMER and GETPULS are called in the manner previously described and a DOUNTIL loop is performed also in the manner previously described. The results determine if the index pulse is occurring properly at the desired high speed. Additionally, print velocity CKPRTVEL, paragraph 5.12, is checked. This routine times the interval between two successive index pulses to insure correct print speed 72, FIG. 5. CKPRTVEL, paragraph 5.12 and CKLDVEL, paragraph 5.11, operate similarly. As a result of the higher speed, the resolution is not quite the same so that instead of timing eight tachometer pulses on line 210, the timing is from index to index which comprises 256 tach pulses.

In the PROFILE routine, the next step involves drum deceleration 75, FIG. 5. This subroutine determines (1) how long it takes to decelerate and (2) how far along the surface of drum 10, this deceleration takes place. For the reasons later to be described, the distance value is preferable to that of time and is accomplished by starting deceleration at the same time as the tachometer indexed on line 116. Then it is determined how many revolutions plus how many TACH COUNTS it takes to decelerate drum 10 until the AT SPEED signal on line 212 again occurs which indicates that the drum is at load speed segment 71. These two measurements are important in determining whether there may be an optimal point of deceleration during actual printing. It is desired that deceleration on segment 75 begin at a time so that the end of the segment 75 is reached at the best time to remove the paper. Specifically this is accomplished by using the index on line 116 as a reference for deceleration segment 75 and the OVERFLOW COUNT (a number in a register in microprocessor 300) is set to zero.

A LOAD VELOCITY command in block 146 is set which decelerates drum 10 down to load velocity 71. TIMER is set to one second as a safety timeout to prevent hang up. DOUNTIL is looped until the signal on drum at speed line 212 or TIMER is zero. In the DOUNTIL loop, OVERFLOW COUNT tracks the number of drum revolutions which is the number of indexes 116 which have been seen. In addition, by looking at TACH COUNT, the fractional part of the drum revolution is calculated so that there is a precise indication of the drum position when the DRUM AT SPEED signal is received. In this manner, at the time of the DRUM AT SPEED signal, there is known the revolutions in the OVERFLOW COUNTER as well as the TACH COUNT and calculation may take place.

Accordingly, there will now be determined for the profile, the actual values of the critical operating parameters PLSTART and PLREVS. PLSTART is the desired place where deceleration should be started during the print cycle and PLREVS is the desired number of index pulses that should be seen during the course of the deceleration. To release the paper at the proper point, DRUM AT SPEED should come up 109° from index 116 which is the optimum deceleration. Accordingly, puffer line 152 should be actuated at 80° from index 116 during that last rotation of drum 10. Thus, just before DRUM AT SPEED comes up at 109°, the PUFFER should lift the leading edge of the paper so that it will detach from the drum. It should be noted that 109° actually equals 77 tach pulses. In the calculation of deceleration time, since TIMER started at one second, if one second were subtracted from the value at TIMER end and the complement taken, the resultant is the deceleration time (DECTIM).

In the determination of PLSTART and PLREVS, the reference point is effectively determined from which point deceleration should take place in order to reach load speed at the proper position. It will be understood that after profiling and in the use of the stored critical parameters, if the print cycle has not reached this reference point, it is important that the cycle continue at the higher print speed until it reaches the reference point and only then should deceleration take place. This is to be compared with undesirably starting deceleration before the reference point and then rotating at the slower load speed until a proper release point is reached. The preferable operation is performed in the PROFILE routine by considering whether TACH COUNT is greater than 77 or less than 77. If TACH COUNT is greater than 77, then 77 is subtracted from it. Otherwise, the TACH COUNT is subtracted from 77, the result complemented and one is added to the OVERFLOW COUNTER. The result then is stored in PLSTART and the revolutions in PLREVS. In this manner, it is now known the point at which to start deceleration in order to optimize printing.

CKLDVEL, paragraph 5.11, is now called to check if load speed servo 96 functions properly both for segment 71 and for segment 70. There has now been completed drum profiling and all of the drum critical parameters have now been obtained.

Transport Profiling

There will now be described the profiling of transport 254 of array transport system 250, FIG. 2B. Routine PRO3, paragraph 15.1, may be entered in two ways. The first way is on the initial profile of the day. In the second way, the cabinet of system 15 has been opened or transport 254 has been moved away from stops 290, 292. When the cabinet has been opened a signal is produced on interlocks line 222 and when transport 254 has been moved away from stops 290, 292, respective sensors 204*a*, 206*a* feeding lines TPT home 204 and TPT away 206 are not indicating end of travel. During operation either the opening of the cabinet or the transport being away from the stops, is detected in routine STARTIT, paragraph 7, and transport 254 is placed at one edge or the other before printing starts.

In routine PRO3, there is first called TPTHOME, paragraph 5.7. This returns transport 254 to home end stop 290 and the only checking being performed is a safety timeout of eight seconds. The MOVE HOME command on line 194 is transmitted to transport 254 until the TIMER counts down to zero or home sensor 204*a* provides a signal 280 on home sensor line 204. Using routine MSTIMER, paragraph 5.2, ERROR FLAG 5 is set if TIMER reaches zero before signal 280 appears on sensor line 204. If there is no error, TPT move home line 194 is dropped or the signal is removed and the routine returns to the caller at PRO3.

Thereafter, the following profiling determines the amount of time it takes for transport 254 to go from stop 290 to the closest or adjacent edge of the paper. This time will be measured and stored. In this routine, TIMER is set to one second and the signal on TPT move away line 196 is raised. It will be understood that it is necessary that transport 254 be at print speed 284 as shown on the velocity curve before pulse 280 reaches its falling edge 280*a*. The routine also measures and tests the amount of time it takes to reach the adjacent paper edge.

For the next step, MSTIMER, paragraph 5.2, is called. The loop continues until TIMER counts to zero which is an error indicated by FLAG 3. On the other hand, if TIMER does not count out, then the edge of the paper has been reached. Following this loop, one second is subtracted from the value in TIMER and the result complemented giving the elapsed time. This elapsed time is stored in the home time register (HOMETIM). This is one of the calculated transport profile parameters. Thereafter, routine transport velocity (TPTVEL) is called and checked to determine that there is a proper velocity for printing.

The next routine called is TPTAWAY, paragraph 5.8, which is similar to TPTHOME previously described except that its measurements are with respect to away end stop 292. Since printing is done in both directions, the same measurements are performed from stop 292 to the adjacent edge of paper on the away end as was previously performed on the home end. Accordingly, a similar procedure is performed and if there is no error, the resultant elapsed time is stored in AWAYTIM. In the manner previously described, to assure that transport 254 is up to velocity after leaving stop 292, transport velocity (TPTVEL) is again called. Then, TPTHOME, paragraph 5.7, is called to get the transport 254 against stop 290 on the home end. The home delay (HDLY) and the away delay (ADLY) are then calculated as described in the program listing. HDLY is a critical parameter determined during this nonprinting cycle, the existing running value of which is equal to the time difference between (1) the drum accelerate time to print speed and (2) the time that array transport 254 takes to accelerate from home end stop 290 to the closest edge of the paper. Similarly, ADLY is a critical parameter, the actual running value of which is equal to the time difference between (1) the drum accelerate time to print speed and (2) the time that transport 254 takes to accelerate from stop 292 at the away end to the closest edge of the paper.

Accordingly, all six parameters have now been determined with respect to drum and transport profile which may be summarized as follows:

1. HDLY—this is the delay at the home end which starts at the time of the command to accelerate drum 10 to print speed to the time of the command for transport 254 to move away.

2. ADLY—this is the delay at the away end which starts at the time of the command to accelerate drum 10 to print speed to time of the command for transport 254 to move away.

3. ACCTIM—this is the time it takes to accelerate drum 10 from load velocity 70 to print velocity 72.

4. DECTIM—this is the time it takes to decelerate drum 10 from print velocity 72 to load velocity 71.

5. PLREVS—this is the number of tachometer index pulses that occur during drum deceleration which terminates at 109°.

6. PLSTART—this is the TACHOMETER count to start drum deceleration from print velocity 72 to load velocity 71 when the drum reaches 109°.

All of the above are critical operating parameters except for DECTIM which is not critical and is only used by service personnel. A critical operating parameter is defined for purposes herein as a selected one of the many operating parameters of system 15 which determines or is otherwise material to the performance of the system. A profile taken of a critical parameter is defined for purposes herein as a measurement of the actual value of a critical parameter preferably taken (1) during the start of operation (or restart after an error) and (2) during a nonprinting cycle. During such a nonprinting cycle, system 15 is fully functional but sheet 11 is not moved and no ink is applied. It will be understood that only critical parameters are measured during the nonprinting cycle, except for DECTIM in this embodiment.

Printing Operation After Profiling

The STARTIT routine, paragraph 7, is now entered and the PROFILE COMPLETE FLAG is first tested. Depending on the manner in which STARTIT has been reached from the program flow as shown in the listing, a profile may or may not be performed in the manner previously described. Thereafter, the routine determines if the home and away sensors 204*a*, 206*a* are both off in which case PRO3, paragraph 15.1, is called. RETRY COUNT and COPIES COMPLETE are then set to zero.

The PICK routine, paragraph 8, is now executed to remove paper 11 from input bin 12. It can be seen that the correct paper bin is selected for input of sheets 11. A COCK PICKER command to PAPER PICKER provides a wait of 65 milliseconds until there is a pull back. This command is then dropped and at that time, a finger shoots forward and pushes a single sheet of paper into the feed. After waiting 130 milliseconds, the paper should be under the paper entry sensor line 234, FIG. 3B. If that line is not high, there is a picker failure so that the RETRY COUNT is incremented. This is tried eight times and, if it is not successful, the ERROR FLAG 4 is set and the routine jumps to ERROR.

If there is paper at ENTRY, then the routine waits 250 milliseconds for paper 11 to move down the path into proximity of a paper gate in accordance with the signal on paper gate line 236 which signal indicates the presence of paper 11. After that 250 milliseconds, GATE SENSOR is checked and if the GATE SENSOR is off, ERROR FLAG 4 is set as there must be a jam in the input because the paper reached the entry but didn't reach the gate. If no ERROR FLAGS have been raised, then a sheet is at the gate, ready to be loaded on the drum 10.

The LOAD routine, paragraph 9, follows in which the trailing edge vacuum on line 170, FIGS. 3A–3B, is turned off. These ports are to be closed so that there is additional vacuum on the leading edge of the paper. As the next step, the index of drum 10 is to be located since the drum has been turning and the index has not been tracked. Accordingly, the DOUNTIL loop is executed calling GETPULS, paragraph 5.3, until index line 116 applies a signal. In this way, the index is found and TACH COUNT is initialized.

Paper Loading and Feedback of Paper Position

In the NEXT routine, paragraph 10, the LOAD ADJUST FLAG is the flag set whenever a successful load has been accomplished. It indicates that the time required for the paper to get to the correct paper position on rotating drum 10 has been determined. If that flag is reset, this indicates that a calculation has not as yet been made. Accordingly, it is desired to set a tachometer count of 152 (related to a nominal load time) into a TEMP register, which is one of the program registers in microprocessor 300. In conventional copier systems, that load time would be the constant load time for the system. This time is calculated to be an effective safe time to open the paper gate of sheet feed and transport assembly 17. This safe time is not necessarily optimum but is calculated to get the paper safely on drum 10.

On the other hand, if the LOAD ADJUST FLAG is set, then the TEMP register is loaded with a calculated load value (CALCLOAD). CALCLOAD is a variable defining a critical parameter which is a predetermined calculated time stored in memory. There is then a wait while TACH COUNT equals the value loaded in the TEMP register. Until that time of equality, GETPULS is called which tracks tachometer 95. When that time of equality arrives with TACH COUNT equaling the value in TEMP, a pulse is produced on open gate solenoid line 120 which opens the paper gate in assembly 17 starting paper 11 towards drum 10. The drum continues to be tracked by the next DOUNTIL until TACH COUNT equals 113. Accordingly, GETPULS is called to update the TACH COUNT.

After the DOUNTIL loop is completed, if a sensor in assembly 17 indicates that there is paper on drum 10, sensor line 240 provides no signal because the paper has not arrived at drum 10. TEMP register is set to the TACH COUNT because as long as the paper still has not reached the sensor, TEMP is updated with TACH COUNT for every pass through this loop. When the paper arrives at the sensor in assembly 17, the last updated value of the TEMP register remains in that register which provides an indication of the time paper 11 arrived. This allows the determination of a new CALCLOAD which defines the actual running value of a parameter related to the drum position at the time of releasing the paper. CALCLOAD is now loaded into TEMP2 and CORRECT is set to a desired tach count which is the count at which the paper should have arrived at the sensor.

If TEMP is less than CORRECT, the paper arrived early and TEMP2 is added to half the difference between CORRECT (the time it should have arrived at the sensor) and TEMP (the time it actually arrived at the sensor). The difference is halved because the correction is applied in a direction to cause the paper to arrive late. If the arrival is too late, paper 11 will not stick on drum 10 because the vacuum holes of the drum will be uncovered. Only half the error is added to scale it so that the correction does not inadvertently become too great and the vacuum holes remain uncovered after the paper arrives.

On the other hand, if paper 11 is late at the sensor in assembly 17, then CALCLOAD is updated with TEMP2 less the correction factor of TEMP minus CORRECT. That is to say, the paper gate in assembly 17 is opened earlier in the next loading by the full amount of the error. If the paper were late, it would have tended to uncover the vacuum holes and it is important to correct this quickly by the full error amount so that the vacuum holes can be safely covered. In both cases, the corrections are stored as variable CALCLOAD.

After these calculations, the LOAD ADJUST FLAG is set since the time to open the paper gate has now been adjusted. It will be understood that the foregoing adjustment of the paper arrival time is accomplished at load time. It is not done during profiling since it is not desired that paper actually be moved through system 15 during profiling and into output bin 14. Thus, paper is not moved during the profile process and this self adjustment feature for the paper is achieved during the first copy cycle, i.e., the first time paper is moved through system 15. In this manner, there is provided a feedback adjustment of the paper position during the actual copying process rather than prior to the actual copying process.

The trailing edge vacuum solenoid line 170 is then dropped which causes vacuum to be directed to the tailing edge so that it tacks down paper 11 when the paper reaches that point. Furthermore, the gate solenoid line 120 is also dropped and a PRINT SPEED command to block 131 may be set so that drum 10 accelerates up to PRINT SPEED.

Printing Operation After Paper Loading Using Profile Parameters

Since PRINT SPEED has been set, drum 10 is accelerating and the LOAD1 routine, paragraph 10.1, is now executed. It will be understood that with drum 10 accelerating, the profile parameter HDLY or ADLY is now used to determine when to start the movement of transport 254. As previously described, drum 10 always takes longer to get to speed than moving transport 254 takes to get to the edge of the paper. It is desired to have a delay before transport 254 starts so that it does not get to the edge of paper 11 too quickly. Accordingly, TIMER has been loaded with the interval between startup of drum 10 to PRINT SPEED and startup of transport 254 from stops 290,292 so that the drum reaches print velocity just before the transport reaches the edge of the paper. This has been accomplished by TIMER and HDLY if the transport is on the home end or ADLY if the transport is at the away end.

The system now executes the accelerate routine, ACCEL, paragraph 11. A DOUNTIL loop is executed until TIMER equals zero. In the timing loop previously described, GETPULS, paragraph 5.3, continues to track drum 10 and MSTIMER, paragraph 5.2, continues to track oscillator line 220. At the time at which COUNTER has been counted down, transport 254 is at rest and may now begin its acceleration. Home sensor **204*a* on indicates that transport 254 is at the home end against home stop 290 and segment 284*a* of velocity curve 285 is applicable. On the other hand, away sensor 206*a* on indicates that transport 254 is at the away end against away stop 292 and velocity segment 284*e* is applicable. As a result of the foregoing signals and depending upon the position of transport 254, a signal is supplied from output port 112 and applied by way of move home line 194 or move away line 196**, respectively.

Thereafter, TIMER is set to 250 milliseconds which is a safety delay to insure against system errors or malfunctions. Another DOUNTIL loop is then executed until a respective sensor **204*a*, 206*a* turns off as indicated by falling edges 280*a*, 282*a*, respectively, or in case a malfunction TIMER is counted down to zero. If the TIMER counted down, then ERROR FLAG 5 is set and the system jumps to ERROR because start of print has not been reached within an allowable time. If TIMER had not counted to zero, drum 10 is up to speed as previously described, transport 254 is at the edge of paper 11, and system 15 is ready to print. It will be noted that the system detects whether paper 11 has fallen off the drum 10 during drum acceleration 74, FIG. 5. Specifically, the paper on drum 10 is checked by way of photosensor signal on a paper on drum line 240 from sheet feed and transport assembly 17. Line 240 is coupled to input port 107. If paper 11 is still on drum 10, then the PRINT routine, paragraph 12, is called or else an ERROR FLAG 4 is set which indicates loss of paper and system 15** jumps to ERROR.

In the PRINT routine, if drum-at-speed line 212 from assembly 62, FIG. 1, is not on, then an ERROR FLAG 6 is set which indicates that drum 10 did not get up to speed in time and the system jumps to ERROR. Otherwise, a signal is produced from output port 114 which is applied by way of printer-on line 238 to ungutter the ink spray head on transport 254 and printing may begin. REVOLUTION COUNTER is now set to zero and system 15 requires 224 revolutions of drum 10 to print an entire sheet of paper 11. These revolutions are tracked in the next DOUNTIL loop. At this point, a COUNT routine, paragraph 5.13, is called for incrementing a count of COPIES COMPLETE which was earlier zeroed. When COPIES COMPLETE equals COPIES REQUESTED, a DONE FLAG is set so that no more sheets of paper 11 are fed. It will be understood that a revolution counter is included in the registers of microprocessor 300 and used as a microcoded counter register.

System 15 then returns to PRINT routine, paragraph 12, and TIMER is set to eight seconds. This is a safety timeout in the event of a system error or malfunction caused by transport 254 not arriving at the opposite end of sheet 11. The previously described DOUNTIL loop is performed until 224 revolutions is reached, at which time GETPULS, paragraph 5.3, is called and then sequentially MSTIMER, paragraph 5.2, is also called with the loop. If INDEX FLAG is set when the program returns from GETPULS, the REVOLUTION COUNTER is incremented by each index pulse produced on line 116.

At every ten counts of REVOLUTION COUNTER, a series of checks are made. This is done by a case statement which states that if a case is met, the listed action will be performed. Accordingly, at every ten counts of the REVOLUTION COUNTER, the reset switch line 241, which is coupled to input port 107, and the interlocks line 222, which is coupled to input port 106, are examined. For example, if line 241 indicates that a reset switch has been actuated, a DONE FLAG is turned on so that the copy being printed is the last one. If a cover interlock has been opened, ERROR FLAG 7 is set and the program goes to ERROR to shut system 15 down. In similar manner, other checks are made and other actions are executed when the REVOLUTION COUNTER equals 1, 11, 21, 31, 206, 208, 212, 220 and 221 as set forth in the program.

When the REVOLUTION COUNTER reaches 224, the printer-on command is reset, dropping the signal on line 238 from output port 114. Accordingly, the heads of transport 254 are guttered when printing is completed and the system calls a SLOWUP routine, paragraph 13.

The SLOWUP routine is now entered to stop transport 254 and to decelerate drum 10. This routine uses two variables of the profile, specifically PLREVS and PLSTART. As previously described, PLREVS is the number of index pulses during drum deceleration which was set to end at 109°. PLSTART is the number of tachometer output pulses required to start decelerating from print to load velocity. Accordingly, PLREVS is loaded into COUNT and PLSTART is loaded into COMPARE. A DOUNTIL loop is performed until TACH COUNT equals PLSTART and either of TPT home line 204 or TPT away line 206 is up. System 15 waits for two events. One of the events is for transport 254 to reach either home or away end so that deceleration of the transport may begin. The reason for this first condition is that the 224 revolutions previously counted is actually somewhat short of sensors 204*a*, 206*a*. In addition, there is also a wait for the correct count of tach line 210, FIGS. 3A–3B, so that deceleration of drum 10 may be started. Accordingly, a GETPULS routine, paragraph 5.3, is called until one of these conditions is obtained.

In the next step, if TACH COUNT equals COMPARE (PLSTART having been loaded into COMPARE), then system 15 sets the LOAD SPEED command in block 146 to drum 10. From the profiling, this is the optimum time that has been determined for beginning of deceleration. If TPT home line 204 or TPT away line 206 is up, then there is a corresponding drop in move home line 194 and move away line 196 to decelerate transport 254 so that it won't crash into respective stops 290, 292. Thereafter, if INDEX FLAG (set from index line 116) is on, there is a decrement in COUNT. Therefore, when the system comes out of END DOUNTIL, both transport 254 and drum 10 are decelerating.

Although transport 254, without monitoring, is able to continue to stops 290, 292, the progress of drum 10 must be tracked in order to actuate a puffer in assembly 17 and to detach paper 11. Accordingly, the next DOUNTIL calls GETPULS, paragraph 5.3, and at each index pulse on line 116, COUNT is decremented. At the END DOUNTIL, the COUNT is at zero and drum 10 is on the last revolution. At this last revolution, it is desired to puff paper 11. Accordingly, a turn off signal is applied to leading edge vacuum line 150 from output port 113. Another DOUNTIL routine is performed until TACH COUNT contains a count of 64 which is 90° of revolution of drum 10. To reach that 90° point, GETPULS, paragraph 5.3, is called and at the 90° point, leading edge puff line 152 is brought up. This signal is maintained until drum-at-speed line 212 goes up which occurs at approximately 109° of revolution of drum 10. It will be understood that it may not be exactly 109°, depending upon the accuracy of the calculations and whether system 15 is changing with time. GETPULS, paragraph 5.3, is called until the drum-at-speed signal occurs on line 212.

Profile Recalculation

At this point in the program, there is enough data available from system 15 to permit a recalculation of PLREVS and PLSTART, which are the profiling variables involved in deceleration. Accordingly, RECALC routine, paragraph 13.1, is executed when drum-at-speed line 212 comes up. The data in TACH COUNT (the count at which the signal occurred on drum-at-speed line 212) is set into NOW. Line 212 should have come up at 109° if nothing in system 15 had changed with time and everything had been correctly calculated. Accordingly, if TACH COUNT equals 109°, then no further calculations are performed. If NOW is greater than 77, this would indicate drum 10 had arrived late at load speed and routine LATE is called, paragraph 13.2. In this routine, there is a slight change in parameters to perform a feedback function.

On the other hand, if NOW is less than 77, routine EARLY, paragraph 13.3, is called. After these calculations, a DONE FLAG is checked and, if it is set, the system calls LASTOUT, paragraph 14, which indicates that the last copy of paper 11 has been run and the copy is tracked to output bin 14. System 15 returns to IDLE routine, paragraph 6. If the DONE FLAG is not set, system 15 goes to the NEXT routine, paragraph 10, which loads the next sheet 11 on drum 10 for a multiple copy run.

The LATE routine, paragraph 12.2, indicates that drum 10 had not quite reached speed soon enough. Accordingly, PLSTART and PLREVS are loaded so that they can be adjusted. It will be understood that arriving late is more critical than arriving early since a late arrival may cause difficulty with the detachment of sheet 11. On the other hand, an early arrival means that the time to detach the sheet is lengthened. Thus, in the LATE routine, the entire error is subtracted from PLSTART and PLREVS. A new PLSTART is calculated and if a borrow is required, then PLREVS is decremented. Following these calculations parameters PLREVS and PLSTART are stored.

Since an early arrival only subtracts from the performance of system 15 and is not as critical as a late arrival, the computation in the EARLY routine, paragraph 13.3, is the same as in the LATE routine except that only half the error is used as feedback. The reason for this slow rate of change in adding time is to avoid the possibility of an undesirable late arrival.

It will be understood that the recalculation is only with respect to drum 10 and there is no recalculation with respect to transport 254. Since transport 254 is coming to a stop, this condition is noncritical because it does not take as long to decelerate transport 254 as it does to decelerate drum 10. The transport stop time is for the information of the service man and is not used in the operation of the machine. As long as such stop time is within operating tolerance, it does not effect the performance of system 15.

Continuation of Printing

If it is assumed that the sheet 11 just printed was the last (the number of copies are complete or the reset key 241 has been actuated), LASTOUT routine, paragraph 14, is performed. 250 milliseconds are required for sheet 11 to be detached from drum 10. If an exit sensor in assembly 117 is actuated, a "remove copies" light is lit in display 230. In addition, after one second for the copy to clear the exit path, output port 114 provides dropping signals on vacuum motor line 226 and TPT motor line 228 to servo motor 262. System 15 then returns to IDLE, paragraph 6.

If sheet 11 on drum 10 is not the last copy, then system 15 goes to NEXT, paragraph 10, which is the routine that loads paper. As previously described, a new sheet 11 is then loaded and a new print cycle is initiated.

The ERROR FLAGS are listed in paragraph 16 and need not be described in detail. It is understood that after an ERROR FLAG has been set, the ERROR routine is executed as set forth in paragraph 17, and the profile complete flag is reset, thereby producing a new profiling. After an ERROR, and during possible repairs, a sensor may be changed in position or other changes may be made to copier system 15 which requires a new profiling.

Detailed Description of Microprocessor 300

Figure 4:
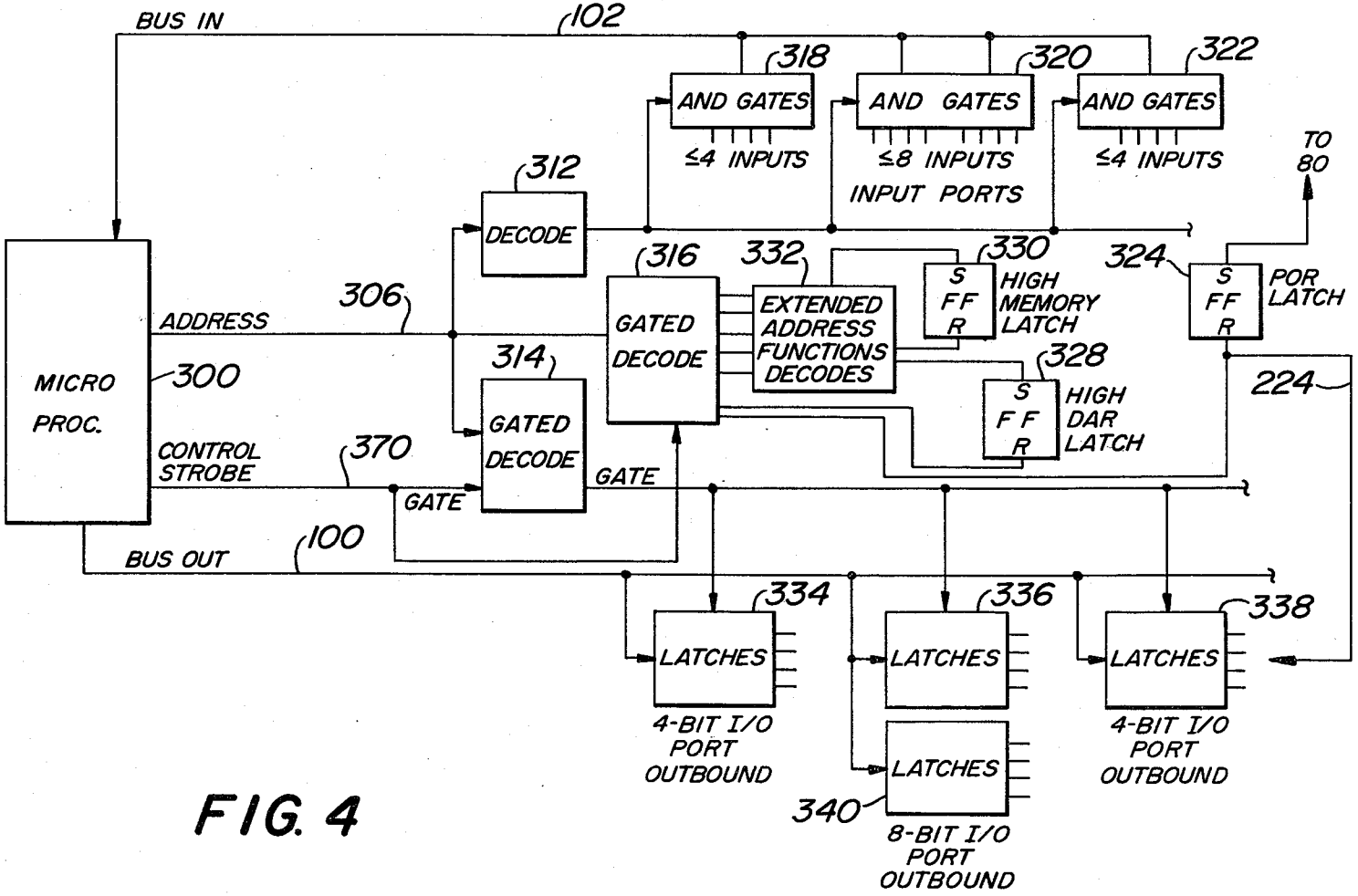
FIG. 4 is a block diagram of the microprocessor and its buses and ports shown in FIGS. 1 and 3A-3B.

In FIG. 4, a block diagram show the physical implementation of microprocessor 300 and its buses as well as input and output ports 104–107 and 110–114. Specifically, microprocessor 300 has an output data bus 100 and an input data bus 102 as well as an eight-bit address bus 306 and a control strobe line 370. Address bus 306 allows microprocessor 300 to address up to 256 input and output ports. Control strobe line 370 is used with bus 100 to set information into an output port which is shown, for example, in FIG. 4 as output gate latches 334, 336 and 338. Address bus 306 signals are decoded by decoder 314 to gate the output gate latches. Similarly, the addresses may be decoded by decoder 312 to select input ports which, for example, are shown as AND gates 318, 320 and 322 which are typical input ports. To extend memory address space, a gated decoder 316 is provided which controls the addressing range of an extended address functions decode block 332. Furthermore, a power on reset latch 324 is provided which is turned on whenever the power is brought up on system 15. Latch 324 resets all the output ports of microprocessor 300 until the resetting of latch 324 by way of line 224.

Although the invention has been particularly shown and described with reference to a preferred embodiment thereof, it will be understood by those skilled in the art that various changes may be made therein without departing from the spirit or scope of the invention.

APPENDIX

TABLE OF CONTENTS

1 CONVENTIONS FOR THE TEXT
2 INPUT/OUTPUT LINES
3 OPERATOR'S PANEL
4 INITIALIZE
  4.1 <INIT> Enter here if (POWER ON RESET)
  4.2 <INIT> enter here from error handling routine
  4.3 RETRY
5 UTILITY ROUTINES
  5.1 RSTPNL
  5.2 MSTIMER
  5.3 GETPULS
  5.4 STARTCE
  5.5 INKUP
  5.6 INKDOWN
  5.7 TPTHOME
  5.8 TPTAWAY
  5.9 STP2LOAD
  5.10 LD2PRT
  5.11 CKLDVEL
  5.12 CKPRTVEL
  5.13 COUNT
  5.14 INK SYSTEM CHECK
6 IDLE
7 STARTIT
8 PICK
9 LOAD
10 NEXT
  10.1 LOAD1
11 ACCEL
12 PRINT
13 SLOWUP
  13.1 RECALC
  13.2 LATE
  13.3 EARLY
14 LASTOUT
  14.1 LATE
15 PROFILE
  15.1 PRO3
16 ERROR FLAG LISTING
17 ERROR
  17.1 HERE

1 CONVENTIONS FOR THE TEXT

- <TERM>
  Terms in < . . . > are routine names and can be found in the table of contents. these terms are normally the target of GOTO or CALL statements.
- (TERM)
  Terms in ( . . . ) are items addressed by the code such as lights, registers, solenoids, flags, etc. These items may be addressed by code statements.
- GOTO
  An unconditional branch to < . . . > label. No return is implied.
- CALL
  A subroutine call to a < . . . > label. Return ia normally to the caller, except when an error condition is detected and return is made to the error handling routines.

2 INPUT/OUTPUT LINES

TRANSPORT OUTPUT
- move away
- move home

DRUM OUTPUT
- accel to load speed
- load speed
- print speed

MISC OUTPUT
- printer on
- vacuum motor on
- transport motor on
- reset por latch
- main power relay
- alternate paper bin
- scan light
- lighter copy
- darker copy PAPER PATH INPUT
- entry sensor

- gate sensor
- paper on drum sensor
- exit sensor

PAPER PATH OUTPUT
- trailing edge vacuum off
- leading edge vacuum off
- puffer
- gate solenoid
- picker (main and alternate)

PANEL OUTPUT
- error light
- add paper light
- add ink light
- remove copies light
- alternate paper light
- lighter copy light
- darker copy light
- copy request display (3 7-segment LED's)

MISC INPUT
- oscillator (changes each 125 micro seconds)
- cover interlock open

TRANSPORT INPUT
- at speed
- home sensor
- away sensor
- tachometer

DRUM INPUT
- at speed
- tachometer
- index

PANEL INPUTS
- ten key pad (calculator-type keypad)
- start key
- reset key
- lighter copy switch
- darker copy switch
- alternate paper switch

3 OPERATOR'S PANEL

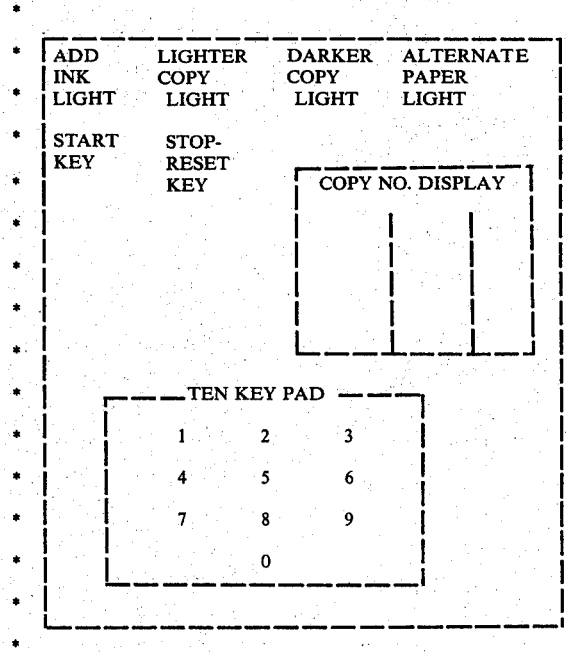

4 INITIALIZE 4.1 <INIT> ENTER HERE IF (POWER ON RESET)
- DO
  reset (COPY REQUEST) flag
  Turn on (MAIN POWER RELAY).

4.2 >INIT1> ENTER HERE FROM ERROR HANDLING ROUTINE
  Reset all (ERROR FLAGs).
  Turn on (NOT READY LIGHT).
  Call >RSTPNL>
  Reset (PROFILE COMPLETE FLAG).
  Reset (LOAD ADJUST FLAG)
  set (CALCLOAD) to 152 (214 degrees)
  note: this is the nominal gate time for loading the drum.
  if (HEAD UP FLAG) is off, then call <INKUP>
  Turn off (NOT READY LIGHT).
IF (COPY REQUEST) flag is on, GOTO <RETRY>
else GOTO <IDLE>

4.3 RETRY
<RETRY> DOUNTIL (START KEY) or (RESET KEY)
- integrate (START KEY) and (RESET KEY)
- END DOUNTIL
  IF (START KEY) is active, GOTO <STARTIT>
  if (RESET KEY) closes, GOTO <IDLE>

5 UTILITY ROUTINES 5.1 RSTPNL
<RSTPNL> (clears the panel to the reset state)
- DO
  set (COPY REQUEST COUNT) to 1
  update (COPY REQUEST DISPLAY)
  turn off (LIGHTER COPY) and (DARKER COPY lights
  turn off (ADD INK) light

RETURN 5.2 MSTIMER
<MSTIMER> This routine samples an oscillator on an input port and updates the (TIMER) upon each oscillator change. The oscillator changes each 125 micro seconds
- input (OSCILLATOR)
- IF (OSCILLATOR) is same as (LASTOSC), then RETURN to caller
  else, decrement (TIMER) and set (LASTOSC) to (OSCILLATOR)
- RETURN 5.3 GETPULS
<GETPULS> This routine tracks a rotating drum using a (TACHOMETER) having 256 changes per revolution. An (INDEX PULSE) occurs once per revolution of the drum. Upon detecting the (INDEX PULSE), the (INDEX FLAG) is set on and the tach counter reset to zero to prevent accumulative errors.
- reset (INDEX FLAG)
- input (TACHOMETER) and (INDEX PULSE)
- IF (INDEX PULSE) is on, then set (INDEX FLAG) on and (TACH COUNT) to zero and RETURN
- else, if (TACHOMETER) is equal to (OLDTACH), then RETURN
  else, increment (TACH COUNT) and set (TACHOMETER) into (OLDTACH)
- RETURN 5.4 STARTCE This routine calls a series of diagnostic tests which are not pertinent to this disclosure except that some of the tests print out the results of the profile measurements for examination by the machine service personnel.

5.5 INKUP

<INKUP> (brings up the ink system pressures and levels) (this routine is no shown here as it is not pertinent to the disclosure) except for the following step . . .

- set (HEAD UP FLAG)

RETURN 5.6 INKDOWN

<INKDOWN> this routine is not shown here in detail since the only item that is pertinent to this disclosure is . . .

- reset (HEAD UP FLAG)

RETURN 5.7 TPTHOME

<TPTHOME> this routine returns the transport to home end with minimum checking

- set (TIMER) to 8 seconds
- IF (HOME SENSOR) is on, then RETURN
- else, set (MOVE HOME) command to transport DOUNTIL (TIMER) equals zero or (HOME SENSOR) is on

- CALL <MSTIMER>

END DOUNTIL

- IF (TIMER) equals zero, then set (ERROR FLAG 5) and GOTO <ERROR> else, transport has reached home end ok.

- drop (MOVE HOME) command to transport
- RETURN 5.8 TPTAWAY

<TPTAWAY> This routine returns transport to the away end with minimum checking.

- set (TIMER) to 8 seconds
- IF (AWAY SENSOR) is on, then RETURN
- else, set (MOVE AWAY) command to transport DOUNTIL (TIMER) equals zero or (AWAY SENSOR) is on

- CALL <MSTIMER>

END DOUNTIL

- IF (TIMER) equals zero, set (ERROR FLAG 5) and GOTO <ERROR> else, transport has reached away end ok

- drop (MOVE AWAY) command to transport
- RETURN 5.9 STP2LOAD

<STP2LOAD> This routine accelerates the drum from a stop to load velocity with a safety timeout

- set (TIMER) to 45 MSec.
- set (ACCEL TO LOAD SPEED) command to drum

DOUNTIL (TIMER) equals zero or (DRUM AT SPEED) signal

- CALL <MSTIMER>

END DOUNTIL

- IF (TIMER) equals zero, then set (ERROR FLAG 2) and GOTO <ERROR> else, drum accelerated ok

- RETURN 5.10 LD2PRT

<LD2PRT> This routine accelerates the drum from load spped to print speed with a safety timeout.

- set (TIMER) to 700 MSec.
- drop (ACCEL TO LOAD SPEED) and/or (LOAD SPEED)
- raise (PRINT SPEED)

DOUNTIL (TIMER) equals zero or (DRUM AT SPEED) signal

- CALL <MSTIMER>

END DOUNTIL

- IF (TIMER) equals zero, then set (ERROR FLAG 2) and GOTO <ERROR> else, drum accelerated ok

- RETURN 5.11 CKLDVEL

<CKLDVEL> This routine uses a timed loop to check the elapsed time for 8 tach transitions.

- set (COUNT) to zero
- set (LOOP) to zero
- set (TACHOMETER) into (NOW)

DOUNTIL (TACHOMETER) is not equal to (NOW)

- input (TACHOMETER)

END DOUNTIL

DOUNTIL (COUNT) equals 8 (using timed program loop)

- set (TACHOMETER) into (NOW)
- sample (TACHOMETER) till (NOW) is not equal to (TACHOMETER) while incrementing (LOOP) for each sample
- increment (COUNT)

IF (LOOP) is less than maximum or more than minimum, RETURN

- else, set (ERROR FLAG 2) and GOTO <ERROR>

5.12 CKPRTVEL

<CKPRTVEL> This routine times the interval between two successive index pulses to insure correct print speed.

DOUNTIL (INDEX PULSE)

- set (COUNT) equal zero
- input (INDEX PULSE)

END DOUNTIL

DOUNTIL (INDEX PULSE) (using timed program loop)

- input (INDEX PULSE)
- increment (COUNT)

ENDDOUNTIL

IF (COUNT) is less than maxumum or more than minimum, RETURN

- else, set (ERROR FLAG 2) and GOTO ERROR 5.13 COUNT

<COUNT>

- increment (COPIES COMPLETE)

IF (COPIES COMPLETE) equals (COPIES REQUESTED), then set (DONE FLAG)

RETURN 5.14 INK SYSTEM CHECK

<INK SYSTEM CHECK> This routine is not shown here since it is not pertinent to the disclosure. The main functions are . . .

- IF (INK EMPTY SENSOR) is on, then set (ERROR FLAG 12) and GOTO <ERROR>
- IF (INK LOW SENSOR) is on, then light (ADD INK LIGHT)

RETURN

6 IDLE

<IDLE> set (COPIES COMPLETE) to zero

The (NO USE COUNTER) performs a reset of the profile driven functions after an extended period of non-use Reset (NO USE TIMER) to zero DOUNTIL (START KEY CLOSURE), (RESET KEY CLOSURE), (ANY ERROR FLAG), or (COVER INTERLOCK OPEN)

- Integrate (TEN KEY PAD)
  Update (COPY REQUEST DISPLAY)
- Integrate (PAPER BIN SWITCHES)
  Update (ADD PAPER) and (ALTERNATE PAPER) lights
- Integrate (PAPER PATH SWITCHES)
  If paper in path, set (ERROR FLAG 1)
  IF (STACKER EMPTY) switch is on, then turn off (REMOVE COPIES) light
- Integrate (MODE SELECT KEYS)
  Update (LIGHTER COPY) and (DARKER COPY) lights
- Integrate (START KEY), (RESET KEY), and (COVER INTERLOCKS)
  call <INK SYSTEM CHECK>
- Input (OSCILLATOR)
  if (OSCILLATOR) does not equal (LASTOSC)
  then, increment (NO USE TIMER)
  IF (NO USE TIMER) overflows
  then, reset (LOAD ADJUST FLAG), reset (PROFILE COMPLETE FLAG), and set (CALCLOAD) to 152 (nominal)

END DOUNTIL
- IF (RESET KEY CLOSURE), GOTO <RESET>
- IF (ANY ERROR FLAG), GOTO <ERROR>
- IF (COVER INTERLOCK OPEN), GOTO <OPEN>
- IF (START KEY CLOSURE), GOTO <STARTIT>

7 STARTIT

<STARTIT> This routine brings up all the machine functions and calls for a profile if the (PROFILE COMPLETE FLAG) is off and/or the transport is not in the proper position.

DO
- set (COPY REQUEST) flag on
- Clear (DONE FLAG)
- Turn on (VACUUM MOTOR) and (TRANSPORT MOTOR)
- IF (PROFILE COMPLETE FLAG) is off, then CALL <PROFILE>
  this code calls the profile upon the initial copy run or after any error condition has been detected.
- IF (HOME SENSOR) and (AWAY SENSOR) are both off, the CALL <PRO3>
  this call returns the transport to correct start point if it has been disturbed since the last operation.
- Set (RETRY COUNT) to zero
- Set (COPIES COMPLETE) to zero
- Display (COPIES COMPLETE) in (COPY REQUEST DISPLAY)
- turn on (SCAN LIGHT)

We are now ready to load the first sheet of paper and make a copy.

8 PICK

<PICK> IF (ALTERNATE PAPER) light is on, then select (ALTERNATE PAPER BIN)
- else, select (MAIN PAPER BIN)
- output (LIGHTER COPY) and/or (DARKER COPY) to scanner if the respective lights are on
- <PICK1> Output (COCK PICKER) command to (PAPER PICKER)
  Wait 65 MSec.
- Drop (COCK PICKER) command to (PAPER PICKER)
  Wait 130 MSec.

If (ENTER SENSOR) is off, then
- Increment (RETRY COUNT)
- If (RETRY COUNT) is less than 8, then GOTO <PICK 1>
  else set (ERROR FLAG 4) and GOTO <ERROR>
  Else, the sheet has been picked properly and is in the feed path.
  Wait 250 MSec.
- IF (GATE SENSOR) is off, then set (ERROR FLAG 4) and GOTO <ERROR>
  Else, paper has traversed the input path properly and is at the gate ready to be loaded on the drum.

9 LOAD

- <LOAD> Pick (TRAILING EDGE VACUUM) solenoid

DOUNTIL (INDEX FLAG) is on
- CALL <GETPULS>

END DOUNTIL

10 NEXT

- <NEXT> IF (LOAD ADJUST FLAG) is off, set (TEMP) to 152 (214 degrees)
  else, load (TEMP) with (CALCLOAD)

DOUNTIL (TACH COUNT) equals (TEMP)
- CALL <GETPULS>

END DOUNTIL
- Pick (GATE SOLENOID)
  this action starts the paper onto the printing drum
  DOUNTIL (TACH COUNT) equals 113 (160 degrees)
- CALL <GETPULS>
  IF (PAPER ON DRUM SENSOR) is off, then set (TEMP) to (TACH COUNT)
  When the paper reaches the sensor, we will quit updating (TEMP) and leave it containing the count at which the paper reached the sensor.
  END DOUNTIL
- load (CALCLOAD) into (TEMP2)
  set (CORRECT) to desired tach count for paper at sensor to activate.
  If paper was early at sensor, store (CALCLOAD) with (TEMP2)+(((CORRECT)−(TEMP))/2)
  This applies half the error in the early direction which is the most hazardous direction since it tends to uncover the holes in the drum so that paper may not adhere well.
  If paper was late at sensor, store (CALCLOAD) with (TEMP2)−((TEMP)−(CORRECT))
  this applies the full error in the early direction which is the safest move since it insures that the vacuum holes will be covered and the paper will adhere.
- set (LOAD ADJUST FLAG) on
  with the load adjust flag on, gate time will be adjusted according to the accumulated results of actual loads.
- DROP (TRAILING EDGE VACUUM) solenoid
- Drop (GATE SOLENOID)
- Set (PRINT SPEED) command to drum 10.1 LOAD1

<LOAD> IF (HOME SENSOR) is on, then load (TIMER) with (HDLY)
Else, load (TIMER) with (ADLY)
We now have the timer loaded with the interval between the startup of the drum to print speed and the startup of the transport from the stops so that the drum reached print velocity just before the transport reaches the edge of the paper.

11 ACCEL

<ACCEL> DOUNTIL (TIMER) expires.
• CALL <GETPULS>
• CALL <MSTIMER>
END DOUNTIL
IF (HOME SENSOR) is on, then set (GO AWAY) command to transport
else, set (GO HOME) command to transport
• Set (TIMER) to 250 MSec. (safety delay)
DOUNTIL (TIMER) expires or (HOME SENSOR) and (AWAY SENSOR) are both off
• CALL <GETPULS>
• CALL <MSTIMER>
END DOUNTIL
IF (TIMER) has expired, then set (ERROR FLAG 5) and GOTO <ERROR>
else, transport has reached start print point within the allowed time.
IF (PAPER ON DRUM SENSOR), then GOTO <PRINT>
else, set (ERROR FLAG 4) and GOTO <ERROR>

12 PRINT

<PRINT> IF (DRUM AT SPEED) is off, then set (ERROR FLAG 6) and GOTO <ERROR>
Output (PRINTER ON) command. (ungutter the head)
• Set (REVOLUTION COUNTER) to zero
• CALL <COUNT> (counts copies printed, sets (DONE FLAG) if last.)
It takes 224 revolutions to print an 8½×11 page. During the printing, certain values of the revolution counter are recognized to sequence the next sheet into the feed and/or the last sheet out of the feed in a multiple copy run.
Set (TIMER) to 8 seconds
DOUNTIL (REVOLUTION COUNTER) equals 224
• CALL <GETPULS>
• CALL <MSTIMER>
• (INDEX FLAG) is on, then increment (REVOLUTION COUNTER)
CASE
• (REVOLUTION COUNTER) equals 10,20,30, . . . (even tens)
Integrate (RESET SWITCH) and (COVER INTERLOCKS)
Set (DONE FLAG) if (RESET SWITCH) closure
Set (ERROR FLAG 7) and GOTO <ERROR> if (COVER INTERLOCK) open
• (REVOLUTION COUNTER) equals 206
IF (DONE FLAG) is off, then output (COCK PICKER) command
• (REVOLUTION COUNTER) equals 208
Drop (COCK PICKER) command
• (REVOLUTION COUNTER) equals 212
If (DONE FLAG) is off and (ENTRY SENSOR) is off, then set (ERROR FLAG 8) and GOTO <ERROR>
• (REVOLUTION COUNTER) equals 220
IF (DONE FLAG) is off and (GATE SENSOR) is off, then set (ERROR FLAG 8) and GOTO <ERROR>
IF (EXIT SENSOR) is on, set (ERROR FLAG 10) and GOTO <ERROR>
this statement checks for jams in the outgoing sheet on a multiple copy run. By this revolution, the sheet should have long since cleared the exit.
IF (EXIT SENSOR) is on, set (ERROR FLAG 10) and GOTO <ERROR>
this statement checks for a prior sheet jammed in the output on a multiple sheet run
• (REVOLUTION COUNTER) equals 1,11,21,31, . . . 221
IF (PAPER ON DRUM SENSOR) is off at 30 degrees or 330 degrees, then set (ERROR FLAG 9) and GOTO <ERROR>
END DOUNTIL
DO
• turn printer off (gutter head)
GOTO <SLOWUP>

13 SLOWUP

<SLOWUP> This routine stops the transport and decelerates the drum. The puffer is actuated at the proper time to detach the paper just as it reaches load velocity at 109 degrees.
DO
• load (PLREVS) into (COUNT)
• load (PLSTART) into (COMPARE)
DOUNTIL (TACH COUNT) equals (PLREVS) and ((HOME SENSOR) or (AWAY SENSOR)) is on
• call <GETPULS)
• If (TACH COUNT) equals (COMPARE), then set (LOAD SPEED) command to drum
• IF ((HOME SENSOR) or (AWAY SENSOR)) is on, then drop (GO AWAY) and (GO HOME) commands to transport
• IF (INDEX FLAG) is on, decrement (COUNT)
END DOUNTIL
We now have both the transport and drum decelerating. The transport will take care of itself from here to the stops, but we must track the prograss of the drum to know where to actuate the puffer and detack the paper.
DOUNTIL (COUNT) equals zero
• CALL <GETPULS>
• IF (INDEX FLAG) is on, then decrement (COUNT)
END DOUNTIL
when we reach here, we are on the proper revolution to puff the paper. So at 90 degrees we will puff.
• DO turn off (LEADING EDGE VACUUM)
DOUNTIL (TACH COUNT) equals 64 (90 degrees)
• CALL <GETPULS>
END DOUNTIL
DO
• set the (PUFFER SOLENOID) on
DOUNTIL (DRUM AT SPEED) signal
• CALL <GETPULS>
END DOUNTIL 13.1 RECALC <RECALC> This routine recalculates the deceleration point for the drum based upon the actual deceleration just experienced.
• set (TACH COUNT) into (NOW)
• IF (NOW) is greater than 77 (109 degrees), then CALL <LATE>
• IF (NOW) is less than 77 (109 degrees), then CALL <EARLY>
IF (DONE FLAG) is on, GOTO <LASTOUT>
• else, GOTO <NEXT>

13.2 LATE

<LATE> This routine adjusts the deceleration point of the drum toward the early direction by the amount of the error detected in the last deceleration. The full amount of error is used since the late direction is the critical direction.

- load (PLSTART) and (PLREVS)
- compute (PLSTART) equals (PLSTART)−(-(NOW)−77) (2's complement)
- IF borrow from last computation, decrement (PLREVS)
- store (PLSTART) and (PLREVS)

RETURN 13.3 EARLY

<EARLY> This routine is similar to <LATE> except that the correction used is only half the error since it is moving the deceleration point later which is the critical direction.

- load (PLSTART) and (PLREVS)
- compute (PLSTART) equals (PLSTART)+(((77−-(NOW))/2) (2's complement) (((77−(NOW))/2) is half the error.
- IF overflow from last computation, increment (PLREVS)
- store (PLSTART) and (PLREVS)

RETURN

14 LASTOUT

<LASTOUT> wait 250 MSec

- IF (EXIT SENSOR) is off, set (ERROR FLAG 11) and GOTO <ERROR>
  else, light (REMOVE COPIES) light
- turn off <SCAN LIGHT>
- wait one second
- IF (EXIT SENSOR) is on, set (ERROR FLAG 11) and GOTO <ERROR>
- turn off (VACUUM MOTOR) and (TRANSPORT MOTOR)

GOTO <IDLE>

14.1 LATE

<LATE> This routine moves the drum deceleration earlier by the amount of error.

15 PROFILE

<PROFILE> CALL <STP2LOAD> (brings drum to load velocity with minimum checking)

CALL <CKLDVEL> (uses program loop to time a series of tach pulses)

- set (TIMER) to 257 MSec. (slightly over one drum revolution at load velocity.)

DOUNTIL (TIMER) is zero or (INDEX FLAG) is on

- CALL <MSTIMER>
- CALL <GETPULS> (sets (INDEX FLAG> if index located)
- END DOUNTIL IF (TIMER) is zero, then set (ERROR FLAG 2) and GOTO <ERROR> else, the index sensor is working ok so proceed do

CALL <LD2PRT> (brings drum to print velocity with minimum checking)

the (timer) contents upon return are a measure of the time required for the acceleration of the drum from load to print velocity. This time is in the form of the remainder of the maximum time allowed for this acceleration.

DO conver (TIMER) residual to elapsed time.

- store (TIMER) in (ACCTIM)
- Set (TIMER) to 33 MSec. (slightly over one revolution at print velocity.

DOUNTIL (TIMER) is zero or (INDEX FLAG) is on

- CALL <MSTIMER>
- CALL <GETPULS>
- END DOUNTIL
- IF (TIMER) is zero, then set (ERROR FLAG 2) and GOTO <ERROR> else, index sensor works ok at high velocity so proceed.

CALL <CKPRTVEL> (uses program loop to time several tach pulses to insure correct print velocity.)

DOUNTIL (INDEX FLAG) is on

- CALL <GETPULS>
- END DOUNTIL

We now are at the drum index point.

DO set (OVERFLOW COUNT) to zero

- Set (LOAD VELOCITY) command to the drum
- Set (TIMER) to one second

DOUNTIL (DRUM AT SPEED) or (TIMER) is zero

- CALL <MSTIMER>
- CALL <GETPULS>
  IF (INDEX FLAG) is on, then increment (OVERFLOW COUNT)
- END DOUNTIL
- IF (TIMER) is zero, then set (ERROR FLAG 2) and GOTO <ERROR>
  Else, drum deceleration is within time bounds and we have the distance measured in revolutions (OVERFLOW COUNTER) and tach pulses (TACH COUNT). Now we will calculate the start point to optimize the deceleration when we detach paper during printing. The following calculations result in two parameters that will be stored and later used to determine the deceleration point of the drum, (PLREVS) and (PLSTART). (PLREVS) is a count of the drum indexes that should be passed during the deceleration. (PLSTART) is the tachometer count at which the deceleration should start to end exactly at 109 degrees. We want (DRUM AT SPEED) to rise at 109 degrees, just after the (PUFFER) is actuated at 80 degrees. 109 degrees equals 77 tach pulses.

DO (TIMER)=Complement ((TIMER)−one second) this derives elapsed time for the deceleration.

- IF (TACH COUNT) is greater than 77, then subtract 77 from (TACH COUNT)
- else, if (TACH COUNT) is less than 77, then subtract (TACH COUNT) from 77, complement the result, and add 1 to (OVERFLOW COUNTER)

Store (OVERFLOW COUNTER) in (PLREVS)

Store (TACH COUNT) in (PLSTART)

Store (TIMER IN (DECTIM)

we now know where to start the drum down from print speed to load speed so that load speed is reached just at 109 degrees. (PLREVS) is a count of index pulses that should occur during the deceleration so that we know when to actuate the puffer on the last revolution. We now want to recheck load velocity to insure that it is stable after the deceleration.

CALL <CKLDVEL>

We are now done with the drum profile so we leave the drum running and do the transport profile next.

15.1 PRO3

<PRO3> CALL <TPTHOME> (brings the transport from an unknown position to the home end with minimum checking.

We now want to measure the time from the stops at each end of the page to the start print point and store the results.

- DO set (TIMER) to one second
- set (GO AWAY) command to transport

DOUNTIL (HOME SENSOR) is off or (TIMER) is zero

- CALL <MSTIMER>

END DOUNTIL

- IF (TIMER) is zero, then set (ERROR FLAG 3) and GOTO <ERROR>
- else, (TIMER)=complement of ((TIMER)−one second)
- store (TIMER) in (HOMETIM)

CALL<TPTVEL> (check transport velocity using program loop)

CALL <TPTAWAY> (locate at the away end with minimum checking)

DO

- set (TIMER) to one second
- set (GO HOME) command to transport

DOUNTIL (AWAY SENSOR) is off or (TIMER) equals zero

- CALL <MSTIMER>

END DOUNTIL

- IF (TIMER) equals zero, set (ERROR FLAG 3) and GOTO <ERROR>
- else, (TIMER)=complement of ((TIMER)−one second)
- store (TIMER) in (AWAYTIM)

CALL <TPTVEL>

CALL <TPTHOME>

We now want to figure the delay between the drum and transport start for each end of the drum. 2 MSec. is added as a safety padding.

DO

- store (HDLY)=(ACCTIM)−(HOMETIM)−2
- store (ADLY)=(ACCTIM)−(AWAYTIM)−2

The profile is now complete. The following items are in store:

(HDLY)- delay at home end from drum print speed command to transport start (ADLY)- same, but for away end (ACCTIM)- time to accelerate drum from load to print velocity (DECTIM)- time to decelerate drum from print to load velocity (PLREVS)- number of index pulses during drum deceleration set to end at 109 degrees (PLSTART)- tachometer count to start deceleration from print to load velocity to arrive at 109 degrees DO set (PROFILE COMPLETE FLAG)

RETURN TO CALLER

16 ERROR FLAG LISTING

- ERROR FLAG 1
  paper in the path during idle
- ERROR FLAG 2
  drum hardware error
- ERROR FLAG 3
  transport did not start or else sensor error
- ERROR FLAG 4
  jam in input paper path
- ERROR FLAG 5
  transport hardware error
- ERROR FLAG 6
  drum did not reach velocity during printing
  cover open signal detected during print
- ERROR FLAG 8
  no new sheet ready at gate during multiple sheet print
- ERROR FLAG 9
  paper on drum signal lost during printing
- ERROR FLAG 10
  jam in output on a multiple copy run
- ERROR FLAG 11
  jam in output on a single copy run or on last sheet
- ERROR FLAG 12
  ink empty. This error results in a machine shutdown until refilled.

17 ERROR

<ERROR> This routine displays the error number in the (COPIES REQUESTED) display and shuts down all machine functions. If the error code is 12 (ink empty), the machine will not restart until shut down and refilled. For all other errors, upon the first depression of the reset key after the error, the error indication is reset. If the (START KEY) is then depressed, the copy run will continue to completion with adjustment made for copies lost in a jam situation. If the (RESET KEY) is depressed a second time prior to depression of the (START KEY), the copy run is adbandoned.

DO

- convert the (ERROR FLAG) number to a numeric code and place it in the (COPIES REQUESTED) display
- CALL <INKDOWN>
- light the (ERROR INDICATOR)
- turn off the (SCAN LIGHT)
- reset (PROFILE COMPLETE FLAG)
- turn off (LOAD SPEED) and (PRINT SPEED) commands to the drum
- turn off (GO AWAY) and (GO HOME) commands to the transport
- turn off (LEADING EDGE) and (TRAILING EDGE) vacuum solenoids 17.1 HERE <HERE> IF (ERROR CODE 12) (ink empty), GOTO <HERE>

DOUNTIL ((RESET KEY) closureand no paper path sensors active)

- integrate (RESET KEY)
- integrate (PAPER PATH SENSORS)

END DOUNTIL

- reset (ERROR LIGHT)
- GOTO <INIT>

What is claimed is:

1. A system for printing having a plurality of operating parameters at least a predetermined one of which is critical in a cycle of printing a copy comprising means for determining the actual value of said critical operating parameter during a nonprinting cycle for providing a profiled critical parameter, means for storing said critical parameter value, means for using said stored critical parameter value as the used value of said critical parameter during printing cycles subsequent to the profiling cycle, said determining means for also determining the actual value of said critical operating parameter during said subsequent printing cycles, and means for updating during each printing cycle the stored critical parameter value in said storing means as a function of the difference between (1) the value of the used critical parameter and (2) the value of said critical parameter determined during that respective printing cycle.

2. A system for printing having a plurality of operating parameters at least a predetermined one of which is critical in a cycle of printing a copy comprising means for determining the actual value of said critical operating parameter during a nonprinting cycle for providing a profile of said critical parameter, means for storing said critical parameter value, means for using said stored critical parameter value as the value of the critical parameter during printing cycles subsequent to said profiling cycle, means coupled to said determining means for updating only the stored critical parameter value in accordance with variations in the value of said critical parameter during said subsequent printing cycles, and means for actuating said determining means upon occurrence of selected conditions to make a new determination of the actual value of said critical parameter in another predetermined profiling cycle while no copy is being printed.

3. The system of claims 1 or 2 in which there is provided means responsive to said actual value of said critical parameter for indicating an error condition when said value falls outside a predetermined acceptable tolerance band.

4. The system of claim 2 in which said updating means includes means for producing a substantially small value of updating when the updating is in a direction which would tend to cause an error.

5. The system of claim 4 in which said updating means includes means for producing a substantially large value of updating when the updating is in a direction which would not tend to cause an error.

6. The system of claims 1 or 2 in which said determining means includes means for individually determining the actual values of a pulurality of critical parameters during a profiling cycle, said storing means including means for individually storing each of said critical parameter values, and said using means including means for individually using each of said stored critical parameter values as the respective values of the critical parameters during printing cycles subsequent to said profiling cycle.

7. The system of claim 6 in which said updating means includes means for updating during each printing cycle only said stored critical parameters.

8. The system of claim 6 in which there is provided a drum loaded with sheet material and rotatable between a load speed and a print speed, said determining means includes first means for measuring a critical parameter value of the drum accelerate time which is the time said drum takes to accelerate from load speed to print speed.

9. The system of claim 6 in which said determining means includes second means for measuring the total distance that the surface of the drum travels during deceleration from print speed to load speed.

10. The system of claim 9 in which said second measuring means includes means for counting a critical parameter value of the total integral number of revolutions said drum travels during said deceleration.

11. The system of claim 10 in which said second measuring means includes means for calculating a critical parameter value of the portion of the drum surface distance between the surface distance traveled during said total integral number of revolutions and said total surface distance during said deceleration.

12. The system of claim 8 in which there is provided an array transport which is movable between a home end and an away end, and in which said determining means includes third means for measuring a critical parameter value of the time difference between (1) drum accelerate time and (2) the time that the array transport takes to accelerate from a stop position at the home end to the closest edge of the sheet material.

13. The system of claim 8 in which there is provided an array transport which is movable between an away end and a home end and in which said determining means includes fourth means for measuring a critical parameter value of the difference between drum accelerate time and the time that the array transport takes to accelerate from a stop position at the away end to the closest edge of the sheet material.

14. The system of claims 1 or 2 in which there is provided a drum for transporting sheet material and rotatable between load speed and print speed, means for determining during a cycle of loading the sheet material on the drum the actual value of a critical parameter related to the time for releasing the sheet material to the drum, and means for using said critical parameter value for determining the time of releasing said sheet material for loading on the drum during subsequent loading cycles.

15. A copier system having a system for printing including a sheet feed and drum transport and an array transport with each of said transports having a plurality of operating parameters only predetermined ones of which are critical in a cycle of printing a copy comprising means for determining the actual values of said critical operating parameters during a nonprinting cycle for providing profiled critical parameters, means for storing each of said critical parameter values, and means for using each of said stored critical parameter values as the values of the respective critical parameters during printing cycles subsequent to said profiling nonprinting cycle, said determining means for also determining the actual values of said critical operating parameters during said subsequent printing cycles, and means for updating during each printing cycle each stored critical parameter value in said storing means as a function of the difference between (1) the value of the used critical parameter and (2) the value of said critical parameter determined during that respective printing cycle.

16. The system of claim 15 in which there is provided means responsive to said actual values of said critical parameters for indicating an error condition when any one of said values falls outside a predetermined tolerance band.

17. The system of claim 16 in which said updating means includes means for producing a substantially small value of updating which updating is in a direction which would tend to cause an error.

18. The system of claim 17 in which said updating means includes means for producing a substantially large value of updating which updating is in a direction which would not tend to cause an error.

19. The system of claims 15, 16 or 18 in which there is provided means for actuating said determining means in accordance with selected conditions to make new determinations of the actual values of said critical parameters in another nonprinting profiling cycle.

20. The system of claim 19 in which there is provided a drum loaded with sheet material and rotatable between a sheet material load speed and a sheet material print speed, said determining means includes first means for measuring a critical parameter value of the drum accelerate time which is the time said drum takes to accelerate from load speed to print speed.

21. The system of claim 20 in which said determining means includes second means for measuring the total distance that the surface of the drum travels during deceleration from print speed to load speed.

22. The system of claim 21 in which said second measuring means includes means for counting a critical parameter value of the total integral number of revolutions said drum travels during said deceleration.

23. The system of claim 22 in which said second measuring means includes means for calculating a critical parameter value of the portion of the drum surface distance between the surface distance traveled during said total integral number of revolutions and said total surface distance during said deceleration.

24. The system of claim 19 in which there is provided a drum rotatable between a sheet material load speed and a sheet material print speed, means for releasing said sheet material to initiate the loading of said material on the drum, means for determining during a sheet material loading cycle the actual value of a critical parameter related to the time of release, means for storing said critical parameter value, and means for using said stored critical parameter value for determining the time said releasing means releases said sheet material during subsequent loading cycles.

25. The system of claim 23 in which said array transport is movable between a home end and an away end, and in which said determining means includes third means for measuring a critical parameter value of the time difference between drum accelerate time and the time that the array transport takes to accelerate from a stop position at the home end to the closest edge of the sheet material.

26. The system of claim 25 in which said determining means includes fourth means for measuring a critical parameter value of the time difference between drum accelerate time and the time that the array transport takes to accelerate from a stop position at the away end to the closest edge of the sheet material.

27. Apparatus for feeding and transporting flexible sheet material including a drum which is loaded with sheet material during a loading cycle comprising means for releasing said sheet material to initiate the loading of the sheet material on the drum, means for determining during a loading cycle the actual value of a critical parameter related to the time of releasing the sheet material, means for storing said critical parameter value, means for using said stored critical parameter value for determining the time said releasing means releases said sheet material to initiate the loading of the sheet material on the drum during subsequent loading cycles, said determining means including means for determining the drum position at the time of releasing the sheet material to produce said critical parameter value, and means for producing an additional parameter value equal to a preselected fixed time for the sheet material to arrive at the drum.

28. The apparatus of claim 27 in which there is provided means for sensing the value of an arrival parameter related to the time the sheet material arrives at the drum during each loading cycle, means coupled to said sensing means for updating the stored parameter value in accordance with said arrival parameter value during said subsequent loading cycles.

29. The apparatus of claim 27 in which there is provided means for sensing the drum position at the time the sheet material first arrives at the drum during each loading cycle, means coupled to said sensing means and to said storing means for updating during said subsequent loading cycles the stored critical parameter value in accordance with the difference between (1) said drum position at the lime of sheet material arrival during a loading cycle and (2) and said additional parameter value of said preselected fixed time of arrival.

30. The apparatus of claim 29 in which said drum has vacuum openings and in which said updating means includes means for producing a substantially small value of updating when the updating is in a direction which would tend to uncover said vacuum holes.

31. The apparatus of claim 30 in which said updating means includes means for producing a substantially large value of updating when the updating is in a direction which would tend to cover said vacuum holes.

32. The apparatus of claims 28, 29 or 31 in which said determining means includes reference means for providing during an initial sheet material loading cycle a preselected nominal parameter value related to the time of releasing the sheet material.

* * * * *

UNITED STATES PATENT AND TRADEMARK OFFICE

CERTIFICATE OF CORRECTION

PATENT NO. : 4,275,968

DATED : June 30, 1981

INVENTOR(S) : J. W. Irwin

It is certified that error appears in the above—identified patent and that said Letters Patent is hereby corrected as shown below:

Column 7, line 48, change "one" to --on--.

Column 13, line 59, change "and" to --with--.

Column 17, line 62, change "<INIT>" to --<INIT1>--.

Column 20, line 8, change ">INIT1>" to --<INIT1>--.

Column 20, line 12, change ">RSTPNL>" to --<RSTPNL>--.

Column 21, line 8, change "no" to --not--.

Column 25, line 41, before"(INDEX FLAG)", insert --IF--.

Claim 29, line 33, change "lime" to --time--.

Signed and Sealed this

*Fifteenth* Day of *December 1981*

[SEAL]

*Attest:*

GERALD J. MOSSINGHOFF

*Attesting Officer*

*Commissioner of Patents and Trademarks*